US010112216B2

(12) United States Patent
Stratton et al.

(10) Patent No.: US 10,112,216 B2
(45) Date of Patent: Oct. 30, 2018

(54) SYSTEMS, DEVICES AND METHODS FOR SORTING ITEMS

(71) Applicant: United States Postal Service, Washington, DC (US)

(72) Inventors: Christopher M. Stratton, Springfield, VA (US); Gregory J. Smith, Arlington, VA (US); Thomas C. Potter, Oak Hill, VA (US)

(73) Assignee: United States Postal Services, Washington, DC (US)

( * ) Notice: Subject to any disclaimer, the term of this patent is extended or adjusted under 35 U.S.C. 154(b) by 0 days.

(21) Appl. No.: 15/610,206

(22) Filed: May 31, 2017

(65) Prior Publication Data

US 2017/0354993 A1 Dec. 14, 2017

Related U.S. Application Data

(60) Provisional application No. 62/348,598, filed on Jun. 10, 2016.

(51) Int. Cl.

| | |
|---|---|
| ***B07C 3/06*** | (2006.01) |
| ***B07C 3/00*** | (2006.01) |
| ***B07C 3/02*** | (2006.01) |
| ***B07C 3/08*** | (2006.01) |
| ***B07C 3/18*** | (2006.01) |

(Continued)

(52) U.S. Cl.

CPC ..... *B07C 3/06* (2013.01); *B07C 3/00* (2013.01); *B07C 3/003* (2013.01); *B07C 3/008* (2013.01); *B07C 3/02* (2013.01); *B07C 3/08* (2013.01); *B07C 3/087* (2013.01); *B07C 3/18* (2013.01); *B07C 5/00* (2013.01); *B07C 5/04* (2013.01); *B07C 5/38* (2013.01); *B65H 43/00* (2013.01);

(Continued)

(58) Field of Classification Search

CPC ..... B65H 43/00; B65H 2301/43; B65H 2301/432; B07C 3/00; B07C 3/02; B07C 3/008; B07C 3/08; B07C 3/087; B07C 3/18; B07C 5/00; B07C 5/04; B07C 5/38

USPC ..... 700/214, 219, 223; 414/789.5, 789.9, 414/798.5, 798.6, 798.7

See application file for complete search history.

(56) References Cited

U.S. PATENT DOCUMENTS 3,865,365 A * 2/1975 Hardin ..... B07C 1/025 271/178

4,125,253 A * 11/1978 Wangermann ..... B65H 29/001 270/52.06

(Continued)

OTHER PUBLICATIONS

International Search Report & Written Opinion in Application No. PCT/US2017/035146 dated Oct. 19, 2017.

*Primary Examiner* — Leslie A Nicholson, III

(74) *Attorney, Agent, or Firm* — Knobbe Martens Olson & Bear LLP

(57) ABSTRACT

Sorting systems and methods for large quantities of items in industrial processes are described. The systems, devices and methods are for receiving, sorting and removing items dynamically. A first group of items, such as letters or other mail pieces, are injected by a belt into a pocket to a form a first stack, and a progressive displacement divider with amplified output for a given input is extended near the first stack. The divider allows for a second group of items to either be injected to form a second stack behind the divider, or to be diverted and injected into another pocket. The first stack can be removed while the second group is being injected.

20 Claims, 17 Drawing Sheets

(51) Int. Cl.

| | |
|---|---|
| ***B07C 5/04*** | (2006.01) |
| ***B07C 5/00*** | (2006.01) |
| ***B07C 5/38*** | (2006.01) |
| ***B65H 43/00*** | (2006.01) |

(52) U.S. Cl.
CPC .... *B65H 2301/43* (2013.01); *B65H 2301/432* (2013.01)

(56) References Cited

U.S. PATENT DOCUMENTS

| | | | | |
|---|---|---|---|---|
| 4,273,491 | A * | 6/1981 | Roux | B65H 29/246 193/23 |
| 4,518,160 | A | 5/1985 | Lambrechts et al. | |
| 5,112,042 | A | 5/1992 | Tilles et al. | |
| 5,358,232 | A | 10/1994 | Arendes et al. | |
| 5,833,076 | A * | 11/1998 | Harres | B07C 1/025 211/51 |
| 6,302,638 | B1 * | 10/2001 | Eggebrecht | B65G 47/082 271/181 |
| 6,322,315 | B1 * | 11/2001 | Schmidt | B65H 31/3009 198/431 |
| 6,634,639 | B2 * | 10/2003 | Kuroda | B65H 29/14 271/178 |
| 7,207,560 | B2 | 4/2007 | Enenkel | |
| 7,470,102 | B2 | 12/2008 | Gendron et al. | |
| 7,997,570 | B2 * | 8/2011 | De Matteis | B65H 31/32 270/39.02 |
| 8,240,652 | B2 | 8/2012 | De Matteis | |
| 8,727,344 | B2 | 5/2014 | De Ambrogio et al. | |
| 9,376,273 | B2 | 6/2016 | Hugues et al. | |

* cited by examiner

SYSTEMS, DEVICES AND METHODS FOR SORTING ITEMS

INCORPORATION BY REFERENCE TO ANY RELATED APPLICATIONS

Any and all applications for which a foreign or domestic priority claim is identified in the Application Data Sheet as filed with the present application are hereby incorporated by reference under 37 CFR 1.57.

This application claims the benefit of priority to U.S. provisional patent application No. 62/348,647, entitled SYSTEMS, DEVICES AND METHODS FOR SORTING ITEMS and filed Jun. 10, 2016, and to U.S. provisional patent application No. 62/348,598, entitled SYSTEMS, DEVICES AND METHODS FOR SORTING ITEMS and filed Jun. 10, 2016, the disclosure of each of which is hereby incorporated by reference herein in its entirety for all purposes and forms a part of this specification.

BACKGROUND

Field

This disclosure relates to sorting items. In particular, features for dividing stacks of items with industrial sorting systems are disclosed.

Description of the Related Art

In many industrial concerns, processing large quantities of items is crucial. For example, many items must be received and handled for sorting, distribution, or are otherwise processed with various processing equipment. Some operations handle thousands or millions of items daily.

As an example, mail delivery operations may involve receiving, unloading, transporting and loading thousands of pieces of mail daily into trays for further processing and delivery. The high volume of mail items means more time must be spent on these and other processes.

This is merely one example of an industrial concern that sorts and receives large quantities of items. Others may include, but are not limited to, retail concerns with large inventories and high daily sales, high volume component manufacturers such as consumer goods, and importing concerns with high volume imports needing sorting and receiving daily.

In these and other contexts, sorting systems and processes may produce sorted collections of items in various collection areas. However, the sorted collections of items must be removed from the collection areas so further sorting processes may make use of the same collection areas. This and other problems with current approaches lead to processing inefficiencies with each sorted collection of items that in aggregate add up to significant losses of time over the course of a day or year.

There is therefore a need for improved systems, devices and methods that allow for more efficient and convenient processing of large volumes of items.

SUMMARY

The embodiments disclosed herein each have several aspects no single one of which is solely responsible for the disclosure's desirable attributes. Without limiting the scope of this disclosure, its more prominent features will now be briefly discussed. After considering this discussion, and particularly after reading the section entitled "Detailed Description of Certain Embodiments," one will understand how the features of the embodiments described herein provide advantages over existing systems, devices and methods for receiving items.

Features for sorting items are disclosed. In particular, features for sorting large quantities of items in industrial processes are disclosed. Systems, devices and methods are described for receiving, sorting and removing items dynamically. In some embodiments, a first group of items, such as letters or other mail pieces, are injected by a belt into a pocket to a form a stack, a divider is controllably extended near the first stack in coordination with further incoming injected items, and a second group of the items are injected to form a second stack behind the divider, with the first and second stack at least partially separated from each other by the divider such that the first stack can be removed while the second group is being injected. Alternatively, instead of or in addition to forming the second stack, further incoming items may be diverted to another pocket for dynamic allocation of the items. Thus, industrial processes involving sorting large quantities of items are performed more efficiently due to dynamically controlled dividing of the item stacks that allows for removal and further processing of some items while further items are simultaneously sorted and received by the system.

In a first aspect, a system for sorting items is described. The system comprises a pocket. The pocket comprises a receiving surface, a sidewall located along a first side of the receiving surface, and a paddle moveably coupled with the sidewall. The system further comprises an injector disposed proximate the pocket. The injector is configured to inject a first plurality of items along a path toward the pocket to form a first stack in the pocket. The system further comprises a progressive displacement system. The progressive displacement system comprises a body, a linear member, a gear system and a divider. The linear member is moveably coupled to the body, and the linear member is moveable in a first direction and a second direction. The gear system is rotatably coupled with the body and is in mechanical communication with the linear member, wherein movement of the linear member is translated to rotational movement of the gear system. The divider is in mechanical communication with the gear system, the divider having a first side and a second side opposite the first side, wherein the rotational movement of the gear system due to movement of the linear member moves the divider between a retracted position and an extended position, wherein a corresponding output movement distance of the divider is greater than an input movement distance by the linear member.

In some embodiments, the system for sorting items further comprises a controller in communicating connection with the progressive displacement system, the controller configured to receive first information related to the first plurality of items and to move the divider between the retracted position and the extended position based on the first information. The progressive displacement system may further comprise an actuator coupled with and configured to move the linear member in the first and second direction. In the extended position, the divider may be located on the path between an outlet of the injector and an inlet of the pocket such that an item injected from the injector will contact the divider, and wherein the injector is further configured to inject a second plurality of items in the first direction toward the pocket to form a second stack in the pocket, wherein the second stack is located adjacent to the divider in the extended position with the second side of the divider facing generally toward the second stack, such that the divider at least partially divides the first stack from the second stack to allow removal of the first stack from the pocket while the injector injects the second plurality of items, and wherein in the retracted position the divider is not located on the path between the outlet of the injector and the inlet of the pocket. The controller may be configured to receive second information related to the second plurality of items and to move the divider between the retracted position and the extended position based on the second information. The system may further comprise a sensor in communicating connection with the controller, the sensor configured to detect a characteristic of the first or second plurality of items, wherein the information related to the first or second plurality of items is based on the detected characteristic. The characteristic may comprise a size of the first stack or a destination for an item. The system may further comprise a paddle coupled with the pocket, wherein the first stack forms against the paddle, the paddle configured to move in response to the first stack forming against the paddle. The sensor may be a switch configured to be switched by the paddle as the paddle moves over the switch. The system may further comprise a gripping system configured to remove the first stack of items from the pocket. The pocket may further comprise a receiving surface, a sidewall located along a first side of the receiving surface, and a paddle moveably coupled with the sidewall, wherein the receiving surface is configured to receive the first and second plurality of items to form the first and second stacks thereon, wherein the sidewall and paddle are configured to position the injected first and second plurality of items on the receiving surface and at least partially against the sidewall and paddle, and wherein the paddle is configured to move in response to the first stack forming against the paddle. The system may further comprise a plurality of the pockets disposed proximate to each other, a plurality of the injectors with each injector disposed proximate to a corresponding pocket of the plurality of pockets, and a plurality of the dividers with each divider disposed proximate to a corresponding injector of the plurality of injectors, wherein the system is configured to sort and inject the first and second pluralities of items into at least one of the plurality of pockets.

In another aspect, a method of sorting items is described. The method comprises injecting a first plurality of items toward a pocket, the pocket comprising a sidewall and a paddle; forming a first stack in the pocket with the first plurality of injected items, wherein the first item in the first plurality of items contacts the paddle; moving a linear member in a first direction, wherein the linear member is in mechanical communication with a gear system that is in mechanical communication with a divider; causing the divider to move based on movement of the linear member in the first direction and mechanical communication to the divider via the gear system; moving the divider to an extended position that is adjacent to the first stack in response to the movement of the linear member in the first direction; and injecting a second plurality of items to form a second stack in the pocket, wherein the divider in the extended position at least partially divides the first stack from the second stack.

In some embodiments, moving the linear member the first distance comprises moving the linear member the first distance based on information related to the first or second plurality of items. The method may further comprise detecting a characteristic of the first or second plurality of items, wherein the information related to the first or second plurality of injected items is based on the detected characteristic. The characteristic may comprise a size of the first stack. The method may further comprise removing the first stack of items from the pocket. The method may further comprise receiving a third plurality of items comprising at least the first and second pluralities of items. The method may further comprise sorting the third plurality of items into at least the first and second pluralities of items.

In another aspect, a system for sorting items is described. The system comprises means for injecting a first plurality of items toward a pocket; means for forming a first stack in the pocket with the first plurality of injected items; means for moving a linear member a first distance, wherein the linear member is in mechanical communication with a gear system that is in mechanical communication with a divider; means for causing the divider to move based on movement of the linear member in the first direction and mechanical communication to the divider via the gear system; means for moving the divider a second distance to an extended position that is adjacent to the first stack, wherein the second distance is greater than the first distance; and means for injecting a second plurality of items to form a second stack in the pocket, wherein the divider in the extended position at least partially divides the first stack from the second stack.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through use of the accompanying drawings. In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

DETAILED DESCRIPTION

The following detailed description is directed to certain specific embodiments of the development. Reference in this specification to "one embodiment," "an embodiment," or "in some embodiments" means that a particular feature, structure, or characteristic described in connection with the embodiment is included in at least one embodiment of the invention. The appearances of the phrases "one embodiment," "an embodiment," or "in some embodiments" in various places in the specification are not necessarily all referring to the same embodiment, nor are separate or alternative embodiments necessarily mutually exclusive of other embodiments. Moreover, various features are described which may be exhibited by some embodiments and not by others. Similarly, various requirements are described which may be requirements for some embodiments but may not be requirements for other embodiments.

Various embodiments of the development will now be described with reference to the accompanying figures, wherein like numerals refer to like elements throughout. The terminology used in the description presented herein is not intended to be interpreted in any limited or restrictive manner, simply because it is being utilized in conjunction with a detailed description of certain specific embodiments of the development. Furthermore, embodiments of the development may include several novel features, no single one of which is solely responsible for its desirable attributes or which is essential to practicing the invention described herein.

Figure 1A:
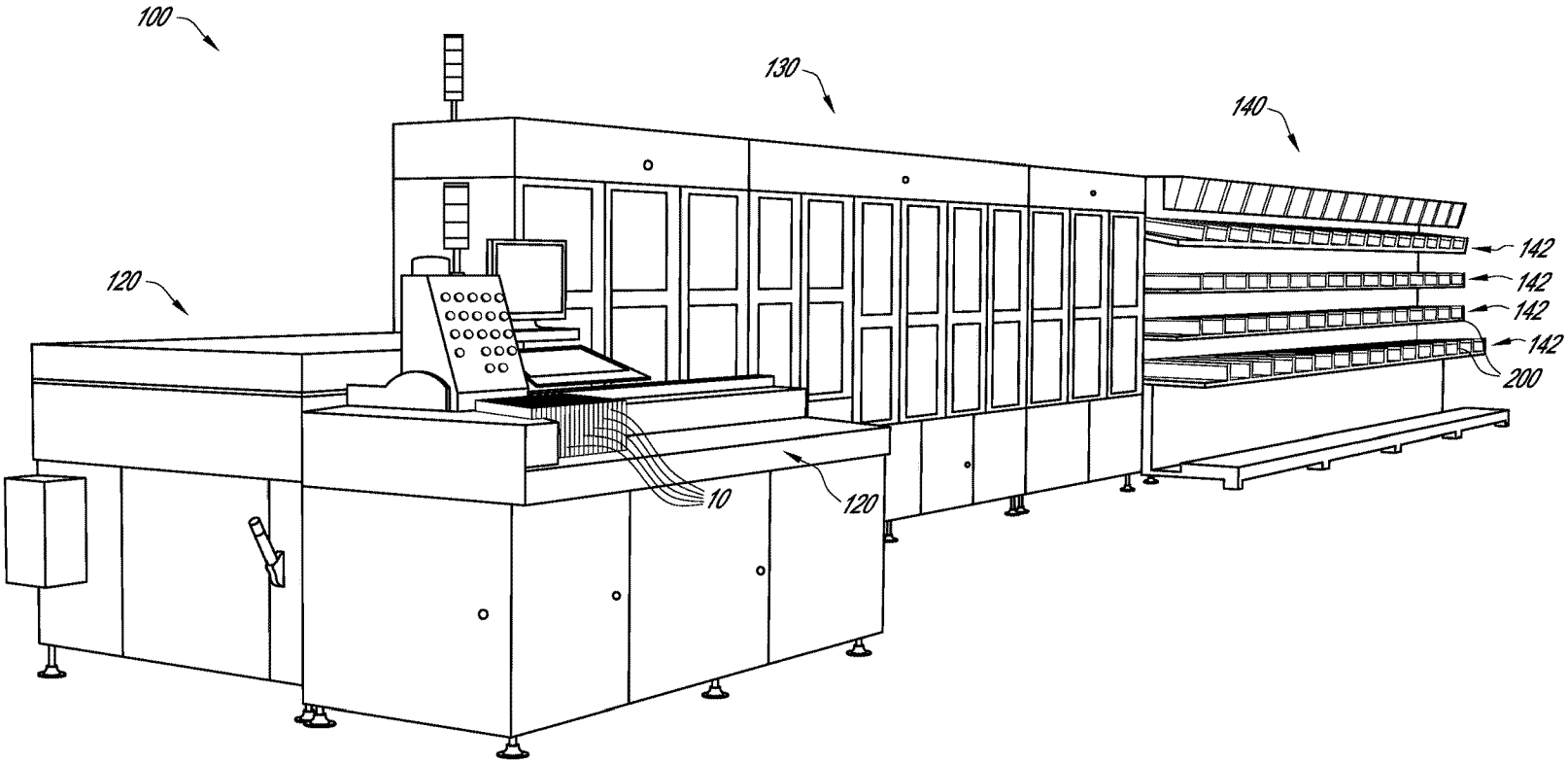
FIG. 1A is a perspective view of an embodiment of a loading system having a sorter and stacker system for receiving and sorting the items into multiple stacks in each pocket of the stacker.

Turning to FIG. 1A, a perspective view of an embodiment of a loading system 100 is shown. The loading system 100 may be located in a facility where a high volume of items are received and processed, for example sorted, and at high frequency, for example, daily. In some embodiments, the illustrated loading system 100 may be located in a mail sorting facility where a high volume of mail items, such as letters and packages, are continuously received and processed.

The loading system 100 may include an intake system 120. The intake system 120 may be a counter or other receiving structure where an items 10 are initially brought into the loading system 100. The intake system 120 may provide a surface or surfaces to place the items 10 and/or to analyze the items. For example, the intake system 120 may have a scanner or imager (not shown) that reads a barcode on the items 10 in order to identify various characteristics of the items 10, such as destination. The intake system 120 may further include a computer to facilitate with the intake and processing of the items 10, for example by receiving and sending data to the intake system 120 regarding the received items 10.

The loading system 100 further includes a sorter system 130. The sorter system 130 may be a large storage and/or conveyor cabinet as shown with various pathways for the items 10 to travel. The sorter system 130, in addition or alternatively to other systems such as the intake system, may also provide equipment to analyze the items. For example, the sorter system 130 may have a scanner (not shown) that reads a barcode on the items 10 in order to identify various characteristics of the items 10, such as destination. The sorter system 130 may further include a computer to facilitate processing of the items 10, for example by sending instructions to the stacker 140 regarding the received items 10. The sorter system 130 is located adjacent or otherwise near the intake system 120. As shown, the sorter system 130 is located next to the intake system 120.

In some embodiments, the items 10 may be delivered from the intake system 120 to the sorter system 130. For example, the items 10 may be put on a conveyor (not shown) which carries the items 10 from the intake system 120 to the sorter system 130. In the sorter system 130 the items 10 are sorted or otherwise processed according to desired parameters, such as intended delivery destination, recipient, sender, size, dimensions, shape, priority, and the like. In some embodiments, the sorter system 130 uses data taken at the intake system 120, such as, for example, from optical character recognition of a surface of the item or scanning a computer readable code, in order to sort the items 10. For instance, computer readable codes, such as bar codes, on the items 10 may be read at the intake system 120 and this data may be used by the sorter system 130 to sort the items 10. The items 10 travel or otherwise move through the sorter system 130 en route to other processing equipment, such as a stacker 140.

In some embodiments, the stacker 140 uses data taken at the sorter system 130, such as, for example, from optical character recognition of a surface of the item or scanning a computer readable code, in order to sort the items 10. For instance, computer readable codes, such as bar codes, on the items 10 may be read at the sorter system 130 and this data may be used by the stacker 140 to sort the items 10. The items 10 travel or otherwise move through the sorter system 130 en route to other processing equipment, such as the stacker 140.

The stacker 140 is a structural system with an array of similar components, which may be stacked, on which the items 10 may be placed. The stacker 140 is located near or adjacent to the sorter system 130. The stacker 140 receives the items 10 from the sorter system 130 and stacks, groups, assembles, or otherwise receives the items in various locations of the stacker 140.

The stacker 140 includes a plurality of pockets 200 in which the sorted items 10 may be received. The pockets 200 are arranged in one or more rows 142. The rows 142 are shown extending horizontally with one row 142 above another, although other configurations are possible. One or more of the pockets 200 in a single row 42 may receive items 10 that are grouped together in some manner, for example by recipient geographic destination, size, and the like. The pockets 200 are discussed in further detail below, for example, with respect to FIGS. 1B and 2. In some embodiments, the items 10 may be mail pieces, such as letters and/or packages, that are sorted by the sorter system 130 and then placed into the proper pockets 200 in the stacker 140. The items 10 may be routed through various sorting components of the stacker 140, as discussed in further detail herein, for example with respect to FIGS. 2 and 3. Once the items 10 are sorted into the proper pockets 200, the items 10 may then be removed from the stacker 140 and transported away for further processing.

The pockets 200 each receive items 10 which have been sorted into common groups by the sorter system 130, based on a common or predetermined characteristic of the item. These groupings may be based on destination, recipient, sender, physical characteristics of the items, and the like. In some embodiments, one pocket 200 is configured to receive a group of items intended for a common destination, or which are intended for destinations within a common route, or which are intended for delivery to any other common geographic area. The sorter system 130 diverts the items 10 into designated pockets 200 of the stacker 140, and the items begin to accumulate in the pockets 200. In some embodiments, the sorter system 130 sends instructions to the stacker 140, which diverts the items 10 into designated pockets 200 of the stacker 140 based on, for example, the intended destinations for the items, and the items begin to accumulate in the pockets 200. The details of these processes will be described in further detail below.

Figure 1B:
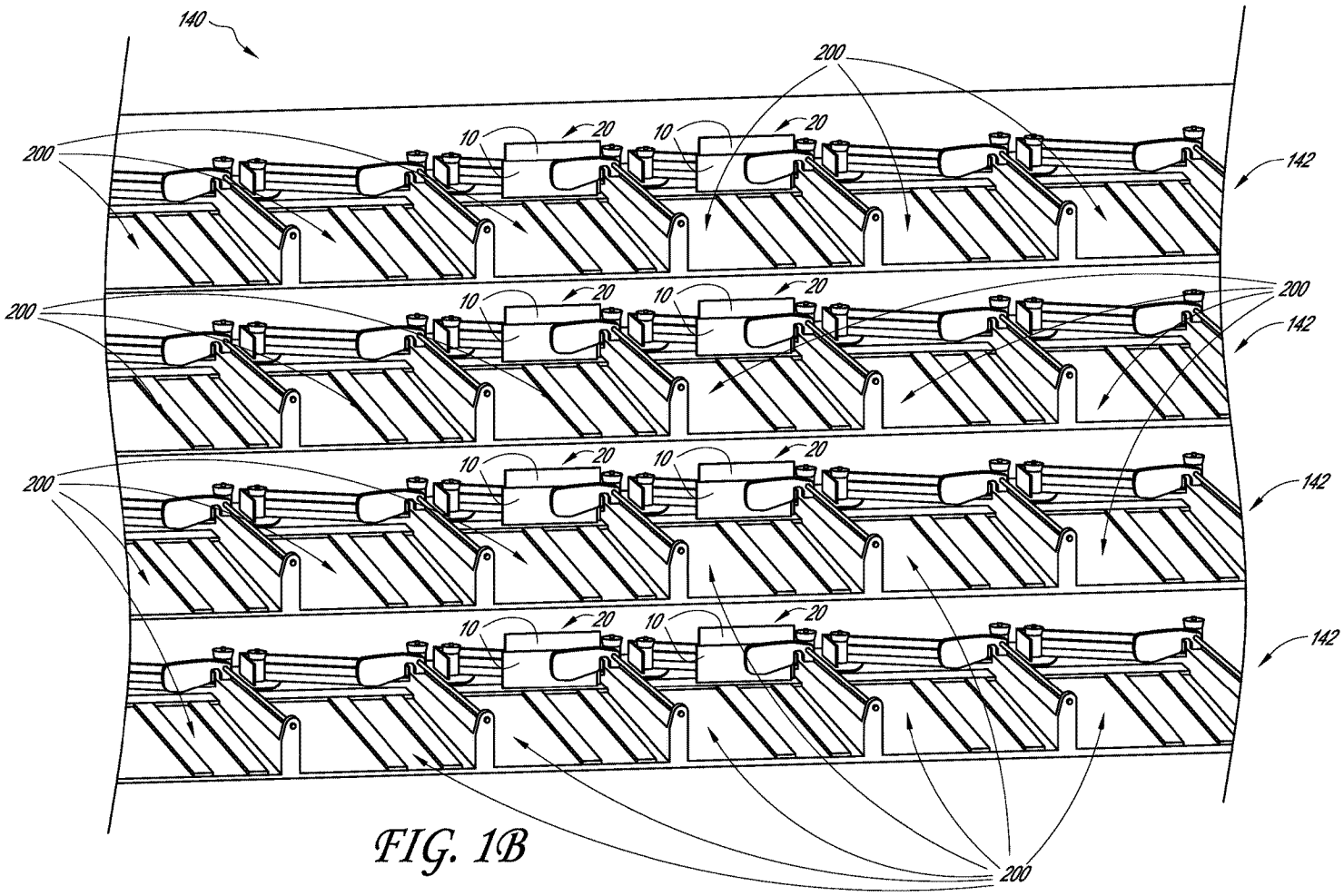
FIG. 1B is a perspective view of the pockets of the stacker of FIG. 1A in which the sorted stacks of items may be formed.

FIG. 1B is a perspective view of a portion of the stacker 140 that includes portions of the rows 142 of pockets 200. The pockets 200 act as receiving areas for the sorted items 10. The pockets 200 may be arranged vertically, such that each subsequent row 142 is directly above the row 142 immediately below it. In some embodiments, the pockets 200 may be arranged at an angle, such that each subsequent row 142 is located slightly farther back, or farther from the front of the stacker 140, than the row 142 immediately below it.

As shown in FIG. 1B, only some of the pockets 200 have received items 10. Further, the items 10 may form stacks 20. The items 10 in a single stack 20 may be contacting an adjacent item 10 or items 10 in that same stack 20. Each stack 20 may include two or more of the items 10 arranged adjacent each other. The stack 20 may include any number of the items 10. In some embodiments, the stack 20 may include about five, ten, fifty, one hundred, five hundred, one thousand, or any greater, lesser or in between number of the items 10. Further details of the items 10 and stacks 20 are described herein, for example with respect to FIGS. 2, 3 and 4A-4E.

Figure 2:
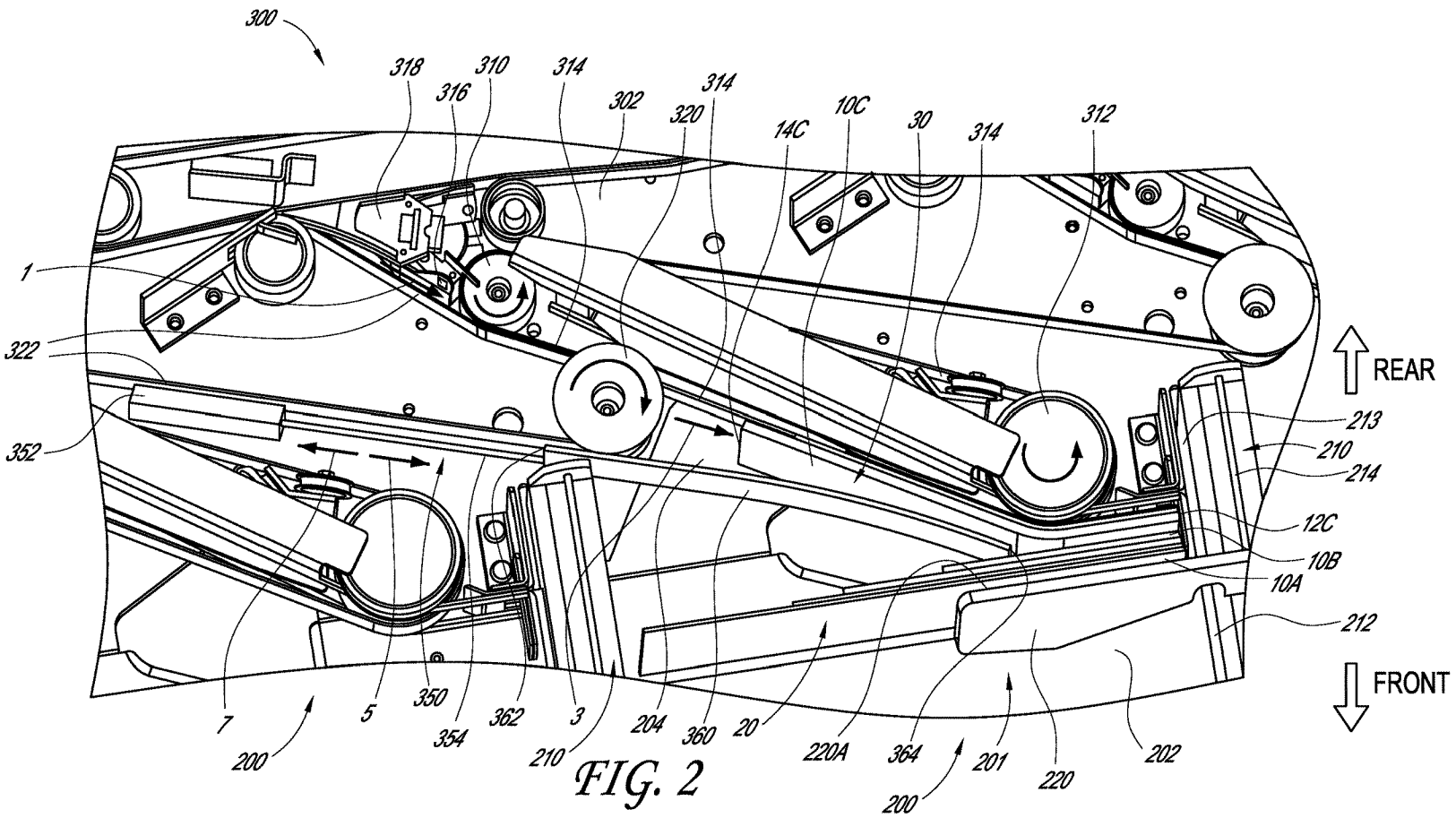
FIG. 2 is a top view of an embodiment of an injector system that may be used with the stacker of FIGS. 1A and 1B to synchronize injection of items and movement of a divider to form the stacks of items in the pockets.

FIG. 2 is a top view of an embodiment of an injector 300. To facilitate description of the injector 300, the front direction (or "frontward," "forward," etc.) and rear direction (or "rearward," "behind," etc.) are indicated as shown. The injector 300 may be used with the stacker 140 to synchronize injection of items 10 and movement of a divider 360 to form the stacks 20 of items 10 in the pockets 200. The injector 300 is located rearward of and adjacent to the pocket 200. However, the various components and features of the injector 300 and the pocket 200 may overlap spatially, as described herein. The injector 300 injects the items 10 into the pocket 200, as further described below.

The injector 300 moves the item 10 along various paths using conveyors, belts, pulleys, rollers, and the like, and ultimately the injector moves the item 10 into a pocket 300. Generally, as shown, the item 10 travels along the direction 1 within the injector 300. The item 10 may be diverted in the stacker 140 and travel in the injector 300 toward the pocket 200 along the direction 1. The item 10 then continues along the direction 3. The item 10 then travels in the injector 300 along the direction 3 and into the pocket 200. This process will be described in greater detail below.

The injector 300 is mounted to a support 302. The support 302 is a structural member that supports the various features of the injector 300 and/or the pocket 200. The support 302 may be constructed of a variety of materials, including but not limited to metals, plastics, other suitable materials, or combinations thereof. The support 302 may be coupled with and include the shelf 201.

The shelf 201 has a front surface 202 bounded by one or more walls 210. The walls 210 are be projecting, structural components located at various locations along the shelf 201. As shown, there are two walls 210 extending along opposite sides of the surface 202 of the shelf 201. In some embodiments, the walls 210 extend vertically upward from sides of the surface 202. The walls 210 may be formed from a variety of materials, including metal, plastic, polymer, other suitable materials and/or combinations thereof. The walls 210 and surface 202 at least partially define boundaries of the pocket 200. As shown, each pocket 200 is at least partially defined by two walls 210 and the surface 202 of the shelf 201. In some embodiments, the support 300 and the shelf 201 may be a continuous structure. The items 10 may interact with one of the walls 210, such as the wall 210 on the right side of the pocket 200 as oriented in the figure, as further described herein.

The injector 300 includes a first pulley 310 and a second pulley 312. The first and second pulleys 310, 312 are rotatably coupled with the support 302. The first and second pulleys 310, 312 may rotate, for example, as shown in a counterclockwise direction as oriented in FIG. 3.

The injector 300 includes a belt 314 disposed on or around the first and second pulleys 310, 312. The belt 314 may be an elongated, flexible material that at least partially wraps around the first and second pulleys 310, 312. As shown, the belt 314 wraps around the first pulley 310 and the second pulley 312 such that rotation of the first and second pulleys 310, 312 moves the belt 314 about the pulleys 310, 312 in the directions of rotation of the pulleys 310, 312. The belt 314 contacts the item 10 and moves the item through the injector 300 along the direction 1. The injector may comprise additional belts and pulleys in order to control the movement of the item 10, including controlling speed, direction, and timing of the movement of the item 10.

The injector 300 also includes a third pulley 320 and a second belt 322. The third pulley 320 may be rotatably coupled with the support 302. The third pulley 320 may rotate, for example, as shown in a clockwise direction as oriented in FIG. 3. The injector 300 includes the second belt 322 coupled with the pulley 320. The belt 322 may be an elongated, flexible material that at least partially wraps around the pulley 320. As shown, the belt 320 wraps around the third pulley 320 such that rotation of the third pulley 320 moves the belt 322 about the pulley 320 in the direction of rotation of the pulley 320. The belts 314, 322 may be or act as pinch belts that pinch the items 10 in between the belts at one or more locations along the travel of the items 10. The belts 314, 322 may pinch the items 10 to move and/or inject the items 10 into the pocket 200, as described below.

Movement of the belts 314, 322 about the respective pulleys 310, 312, 320 facilitates injection of the items 10 into the pocket 200. Once the item 10 has moved into the injector 300, rotation of the pulley 320 moves the belt 322 to move the item 10 along the direction 1. The pulleys 310, 312 rotate to move the belt 314 to further move the item 10 along the direction 1 and toward the pocket 200. The item 10 may be pinched, for example sandwiched, in between the belt 314 and the belt 322 as the item 10 moves closer to the pocket 200. When the item 10 reaches the portion of the belt 322 wrapped around the pulley 320, the item 10 may be injected into the pocket 200 along the direction 3.

The injector 300 includes an item sensor 316. The sensor 316 is coupled with the support 302 at a location along a path of the item 10, for example near or along the direction 1. The sensor 316 detects the presence of the item 10 as it travels in the injector 300 and toward the pocket 200. The sensor 316 may be mechanical, electrical, other suitable types, or combinations thereof. In some embodiments, the sensor 316 may also read information or otherwise detect other characteristics of the item 10, such as destination, size, priority, etc.

The injector 300 also includes a diverter 318. The diverter 318 may be rotatably or otherwise moveably coupled with the support 302. The diverter 318 may be a wedge or other suitably shaped member that diverts the items 10 along the direction 1 and past the sensor 216. The diverter 318 comprises a surface along the path of the item 10 within the injector 300, and the item 10 can impinge on the surface. Orientation of the diverter 318 and the impinging surface guides the item 10 along a pathway, for example, in direction 1. The diverter 318 can rotate or otherwise actuate to move from a first position to one or more other positions in order to selectively divert moving items 10 into pockets 200 based on control signals from a control system, as further described herein, for example, with respect to FIG. 6. The item 10 may be diverted toward the sensor 316 by the diverter 318.

For example, the diverter 318 is actuated when an item 10 moving along the sorting system 130 or into the stacker 140 is intended to be injected into a particular pocket 200. When an item moving to the injector is intended to be sorted to the pocket 200, the diverter 318 actuates to the first position to guide the item 10 into the pocket 200. When an item 10 moving through the stacker 140 is not intended to move into the specific pocket 200, the diverter actuates to the second position, and the item is not guided into the injector 300, but moves along the path to another pocket 300. In this way, the diverter 318 is used to move the item 10 into the injector 300 for a given pocket 200.

The injector 300 includes a divider system 350. The divider system 350 is coupled with the support 302. In some embodiments, the divider system 350 may have its own support. In some embodiments, the divider system 350 may be coupled with the pocket 200. In some embodiments, the divider system 350 may be spread out among various portions of the injector 300, the pocket 200, other portions of the stacker 140, or combinations thereof.

The divider system 350 includes an actuator 352. The actuator 352 may be any suitable actuation device or system to create movement. The actuator 352 may be mechanical, electrical, other suitable types, or combinations thereof. In some embodiments, the actuator 352 may be a pneumatic system. The actuator 352 may be coupled with a shaft 354. The shaft 354 may be moved, for example linearly, by the actuator 352. The shaft 354 may be moved in other manners by the actuator 352. The shaft 354 extends and retracts as the actuator 352 moves. The actuator 352 may actuate along the directions 5 and 7, as indicated.

The divider system 350 includes the divider 360. The divider 360 is coupled with the shaft 354 such that the divider 360 moves along with the shaft 354 when the actuator 352 operates. The divider 360 may extend in the direction 5 and retract in the opposite direction 7, as indicated in FIG. 2 In some embodiments, the divider 360 and shaft 354 may be an integral structural member. The divider 360 is an elongated member with generally flat opposing sides disposed vertically or perpendicularly with respect to the support 302. The divider 360 may have a first end 362 and a second end 364 opposite the first end 362. As shown, the first end 362 is coupled with the shaft 352. The second end 364 is located near the injected items 10 in the pocket 200. The second end 364 may be flat. In some embodiments, the second end 364 may have an angled or other suitable shape to facilitate movement of the divider 360 into and out of the stacks of items 10. The divider 360 may be configured to actuate and divide the items 10 into separate stacks.

FIG. 2 also depicts the first stack 20 of items 10 in the pocket 200. The injected items 10 form the first stack 20 of items 10. The first stack 20 may include a front item 10A that is contacting the rearward surface 220A of a paddle 220. The paddle 220 will be described in greater detail with reference to FIG. 3. One or more other items 10 may be stacked on, in contact with, or aligned behind the rearward facing side of a front item 10A. The first stack 20 may include a rear item 10B located on the rearward-most side of the first stack 20. Thus, the first stack 20 of items 10 may include the front item 10A contacting the paddle 220 and the rear item 10B on the rearward side of the stack 20, with one or more other items 10 in between the front and rear items 10A, 10B. In some embodiments, there may not be any other items 10 in between the front and rear items 10A, 10B. The items 10 may be injected out of an outlet of the injector 300 and/or into an inlet of the pocket 200. The outlet of the injector 300 may be the final portion or region of the injector 300 from which the item 10 is injected. The inlet of the pocket 200 may be an initial portion or region of the pocket 200 in which the item 10 is first received from the injector 300. The outlet of the injector 300 may include regions of the inlet of the pocket 200, and/or the inlet of the pocket 200 may include regions of the injector 300, as portions of the injector 300 and the pocket 200 may overlap, as described herein.

The rear item 10B forms the rear end of the first stack 20, with several items 10 stacked in between the front and rear items 10A, 10B. The divider 360 extends along the direction 5 (as will be explained in further detail elsewhere herein) as indicated to separate the first stack 20 from further incoming items 10. The next incoming item 10C may be injected along the direction 3 as indicated. The divider 360 may be extended in the direction 5 to separate the rear item 10B of the first stack 20, for example from the item 10C. The divider 360 may be retracted in the direction 7.

Injected items 10 may also form a second stack 30 of items 10. As shown, the second stack 30 forms against the divider 360 where divider 360 is extended (as shown). Thus, the divider 360 may be extended into, onto, over or otherwise near a rear surface 204 of the pocket 200 and adjacent the rear item 10B of the first stack 20. The rear surface 204 is described as part of the pocket 200, however it may in addition or alternatively form part of the injector 300. Because the injector 300 and pocket 200 are adjacent each other, there may be overlap between one or more components of the injector 300 and pocket 200, as described herein. The rear surface 204 may form part of the inlet of the pocket 200 described above. The inlet of the pocket 200 may include regions above the rear surface of the pocket 200 as well. Thus, the divider 360 by extending into the pocket 200 such as over the rear surface 204 may prevent further items 10 from being incorporated into the first stack 20 and allows for easy removal of the first stack 20, as described herein. In some embodiments, the second stack 30 forms on or in contact with the divider 360. In other embodiments, as further described herein, the further incoming items 10 after the first stack 20 has formed and the divider 360 has extended may instead be diverted to a different pocket 200. As shown here, the second stack 30 is formed behind the first stack 20 and includes the item 10C as shown. The item 10C is the first item to form the second stack 30, and is in contact with a surface of the divider 360. The item 10C includes a first end 12C and a second end 14C opposite the first end 12C. The first end 12C may contact a wall 210 of the pocket 200 after injection.

The divider system 350 may operate in coordination with the injector 300. The divider 360 may be extended such that the second end 364 is in the shown position as the item 10C is injected. The divider 360 may move into position before or while the item 10C is injected. In some embodiments, the divider 360 is extended into the pocket 200 such that the second end 364 of the divider 360 is in between the first and second ends 12C, 14C of the item 10C as the item 10C is injected into the pocket 200. In some embodiments, the second end 364 of the divider 360 may extend closer to the wall 210, for example the second end 364 may contact the wall 210. However, the second end 364 need not contact the wall 210. Further details of the operation of the injector 300 in coordination with the divider system 350 are described herein, for example, with respect to FIGS. 4A to 4E.

The injector 300 includes a rear wall portion 213. As shown, the wall 210 extends from the wall body 212 located near the front surface 202 to the rear wall portion 213 located on the rear surface 204 of the pocket 200. The pocket 200 may receive the items 10 from the injector 300 and onto the rear surface 204 such that the items 10 contact the rear wall portion 213. The items 10 may be continually injected into the pocket 200 as described to form one or more stacks of the items 10.

The wall 210 includes a body 212 extending along the length of the wall 210. The body 212 is a portion of the wall 210 that contacts and guides the items 10. The body 212 of the wall 210 guides the items 10 in a front direction, as indicated in FIG. 2. The walls 210 include a rail 214. The rail 214 is an elongated member extending along the length of the wall 210. The rail 214 is positioned along a top portion of the wall 210, such as above the body 212 of the wall 210. The rail 214 may be coupled with protruding portions of the body 212 at opposite ends of the wall 210. The rail 214 provides a support for a paddle 220, and provides a guide for the paddle 220, as described herein.

The pocket 200 includes the paddle 220. The paddle 220 is a structural member for receiving and forming a stack 20 of items 10 against the paddle 220. The paddle 220 may have a generally flat, rearward side 220A on which or against which the stack 20 forms. The paddle 220 may have other features to facilitate removal of the stack 20 of items 10 adjacent the paddle 220, such as grooves or slots along the side against which the stack 20 forms. The paddle 220 may be coupled with the rail 214. The rail 214 may be used to guide the paddle 220 along the length of the pocket 210 toward the front and rear. The paddle 220 may translate along the rail 214. The paddle 220 may rotate about the rail 214, for example about an axis parallel to the lengthwise dimension of the rail 214. The paddle 220 may move along the rail 214 as the stack 20 of items 10 form. The paddle 220 may then rotate away from the stack 20 to allow for removal of the stack 20 from the pocket 200. In some embodiments, the paddle 220 may not rotate. For example, the stack 20 may be removed without rotation of the paddle 220. Further detail of the movement of the paddle 220 is described herein, for example with respect to FIGS. 4A to 4E.

Figure 3:
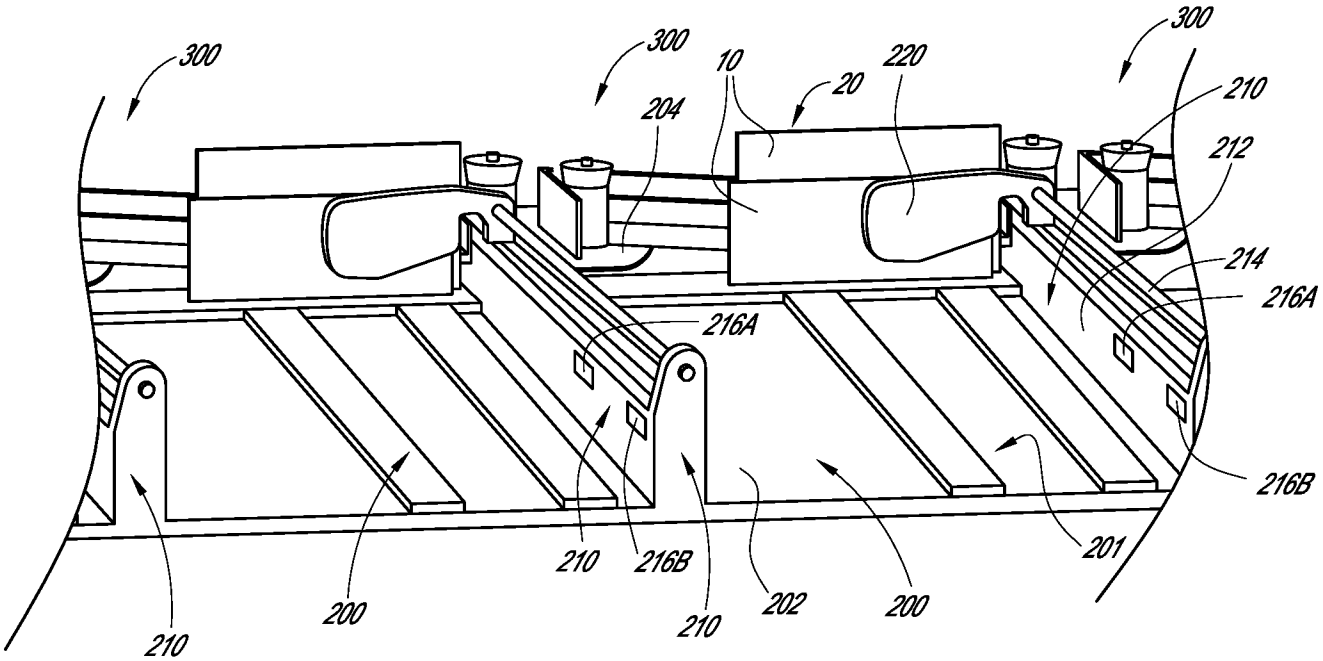
FIG. 3 is a partial perspective view of embodiments of pockets and associated injector systems that may be used to create divided stacks of sorted items in the pockets of the stacker of FIGS. 1A and 1B.

FIG. 3 is a partial perspective view of embodiments of injectors 300 that are used to create the stacks 20 of sorted items 10 in the pockets 200 of the stacker 140. Several pockets 200 are depicted, having injectors 300 adjacent to each pocket 200. The injector 300 injects the items 10 into the pockets 200 as described above. The injector 300 may be used to inject the items 10 into divided stacks, such as a first stack 20 and a second stack 30.

As shown in FIG. 3, the pockets 200 are formed in part by a shelf 201. The shelf 201 is a generally flat, elongated structure upon which the items 10 are received after being injected from the injector 300. The shelf 201 may be any rigid structure capable of supporting the items 10. In some embodiments, the shelf 201 is formed from metal. The shelf 201 may be formed from other materials as well, including plastics, polymers, other materials and/or combinations thereof. The shelf 201 is used to hold items 10 as the items 10 await unloading from the shelves into trays for transportation to another part of the facility for further processing, as will be described in greater detail below.

The shelf 201 has a rear surface 204 that is located rearward of the front surface 202 as oriented in FIG. 3 and in the directions defined in FIG. 2. The rear surface 204 may be defined as the portion of the shelf 201 that is behind the paddle 220. As shown, the rear surface 204 may be located beyond the rearward ends of the walls 210. In some embodiments, one or both walls 210 may extend along one or both sides of the rear surface 204. The rear surface 204 is a portion of the shelf 201 where the items 10 are initially received into the pocket 200 from the injector 300. Thus, the stacks 20 initially form on the rear surface 204 and extend onto the front surface 202. The rear surface 204 may at least partially define the pocket 200. As shown, each pocket 200 is at least partially defined by two walls 210, the front surface 202 and the rear surface 204. The front and rear surfaces 202, 204, or portions thereof, define a receiving region for the items 10.

The pockets 200, include a first sensor 216A and/or a second sensor 216B. The first and second sensors 216A, 216B are disposed in the walls 210. In some embodiments, there may be more than two sensors 216A, 216B. The sensors 216A, 216B detect the presence of the stacks 20 of items 10 and/or other features (such as the paddle 220) in particular locations of the pocket 200. The sensors 216A, 216B are in communicating connection with a control system. The sensors 216A and 216B detect the presence of stacks and communicate data indicating detection of the items 10 and stacks 20 to the control system to control the various parts of the loading system 100, as further described herein, for example with respect to FIG. 6.

The sensors 216A, 216B may be mechanical, electrical, other suitable types, or combinations thereof. The sensors 216A, 216B may be located in various positions of the pocket 200. As shown, the sensors 216A, 216B may be located along the body 212 of the wall 210. In some embodiments, the sensors 216A, 216B may be located in other positions, including but not limited to the shelf 201 or other portions of the wall 210.

FIGS. 4A to 4E are partial perspective views of the stacker 140 showing a part of the injector 300 and pockets 200 at different points in time during injection of the items 10 into the pockets 200. For ease of depiction and explanation, some components of the injector 300 are not shown in FIGS. 4A to 4E. Only one of the pockets 200 is shown receiving the items 10. It is understood that this is for clarity and description only, and that other pockets 200 may also receive additional items 10 with respective portions of the injector 300. The various pockets 200 may receive the items 10 concurrently or at different times.

Figure 4A:
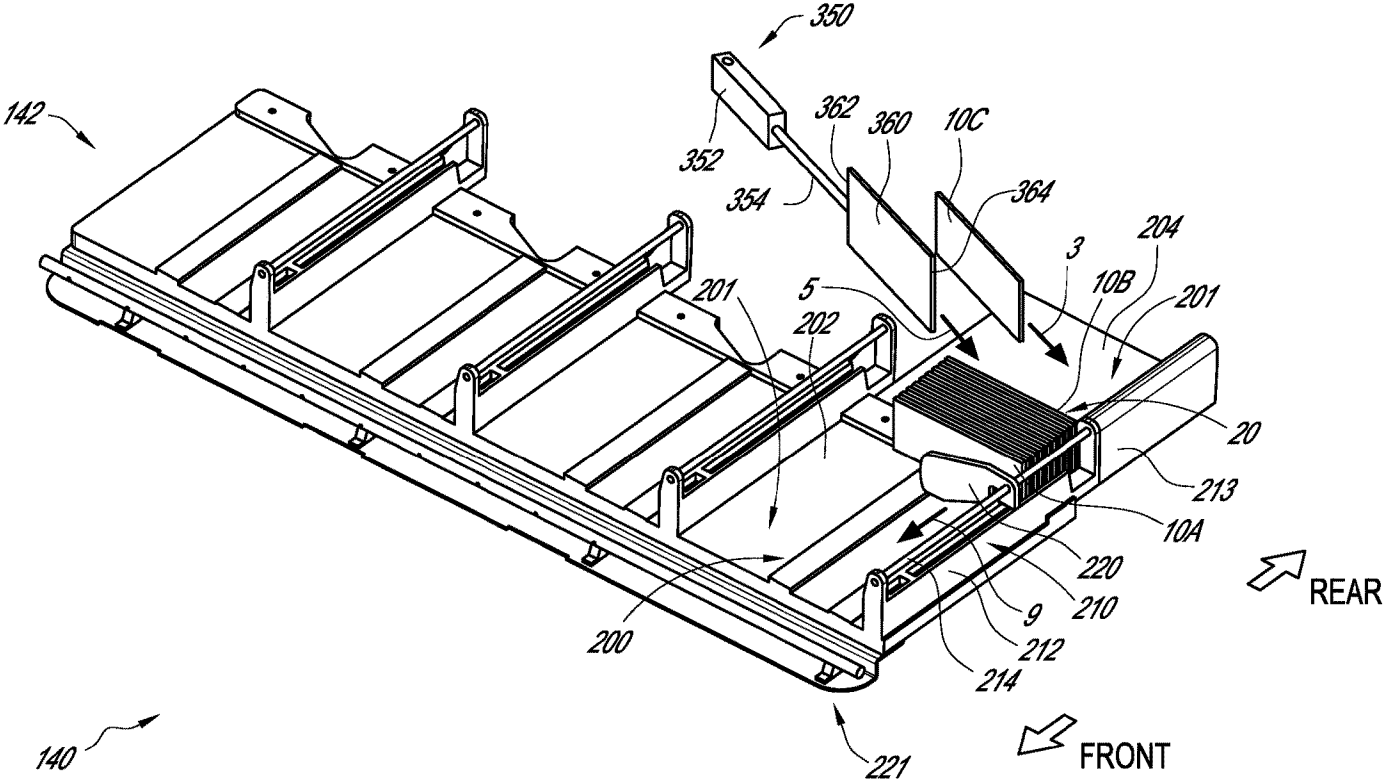
FIG. 4A is a partial perspective view of the stacker of FIG. 1A showing the divider in the retracted position and items forming a first stack behind a paddle in one of the pockets.

FIG. 4A is a partial perspective view of the stacker 140 showing the divider 360 in the retracted position and the items 10 forming the first stack 20 on the paddle 220 in one of the pockets 200. As shown, several items 10 have been injected into the pocket 20 to form the first stack 20. The first stack 20 is formed by the front item 10A contacting the rear surface 220A of the paddle 220, and the first stack 20 grows as further items are injected by the injector 300. The paddle 220 is shown in a position, for example a rotated position, such that the paddle 220 is located near the front surface 202 of the pocket 200. As the additional items 10 are injected into the pocket 200, the paddle 220 may move along the direction 9 as indicated. The paddle 220 may move in the direction 9 while the first stack 20 is forming. By moving, the paddle 220 creates more space for additional items 10 to be injected into the pocket 200 and be incorporated into the stacks 20. The paddle 220 may be spring-loaded to provide constant pressure on the stack 20. In addition or alternatively, the paddle 220 may be actuated, for example by an actuator or motor (not shown), to translate and/or rotate the paddle 220, as described further herein.

The pocket 200 also includes an edge 221 extending along the length of the pocket 200 and adjacent pockets 200. The paddle 220 may move toward the edge 221 as the first stack 20 grows.

Figure 4B:
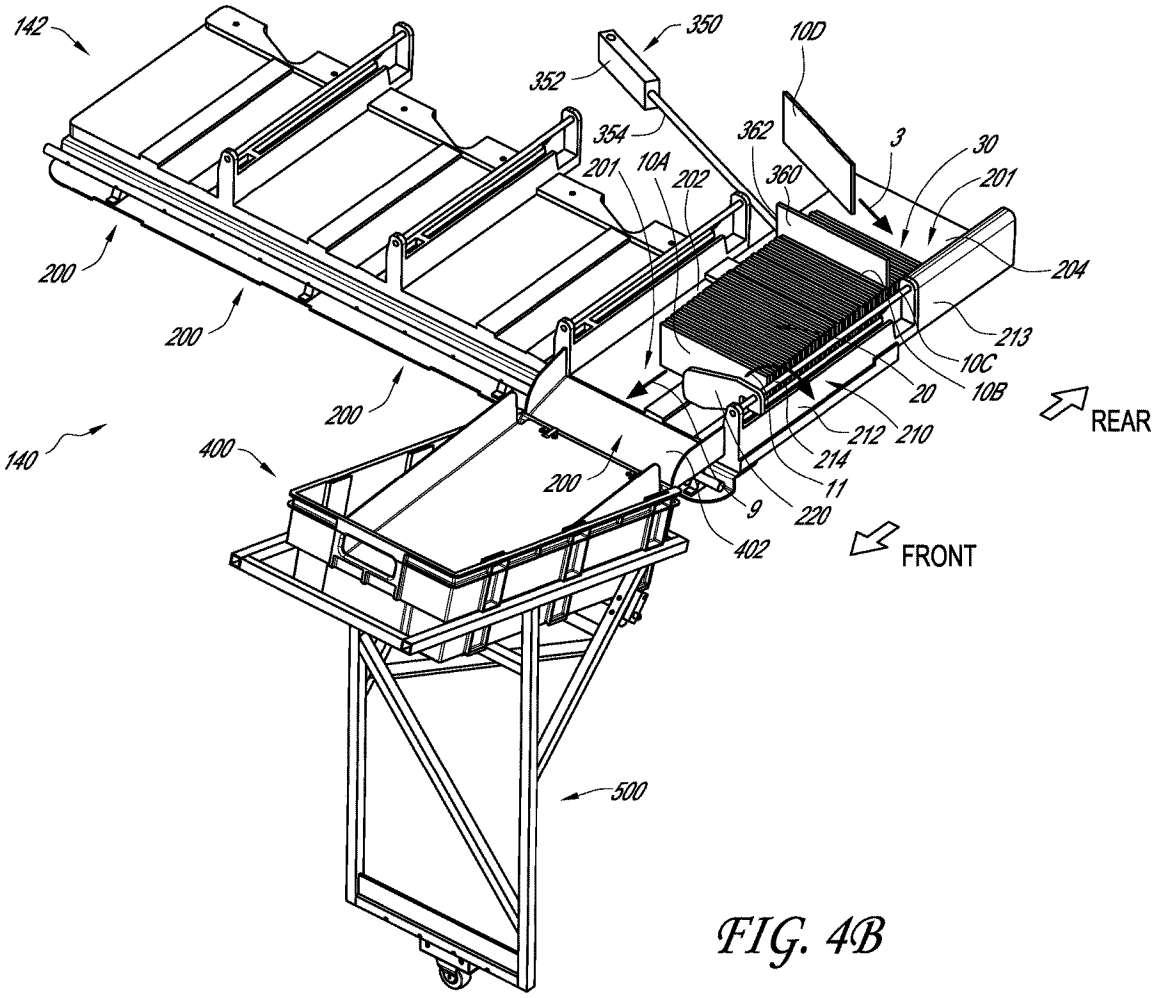
FIG. 4B is a perspective view of the stacker of FIG. 4A showing the divider in the extended position and a second stack of items forming on the divider behind the first stack, an embodiment of a carriage and tray system for transport of the sorted items.

FIG. 4B is a partial view of the stacker 140 showing the divider 360 in the extended position and a second stack 30 of items 10 forming on the divider 360 behind the first stack 20. The paddle 220 moves down the pocket in the direction 9 to accommodate items 10 in the pocket 200, and the first stack 20 grows. The stacker 140 may be in the configuration shown in FIG. 4B at a later point in time as the configuration shown in FIG. 4A. As shown in FIG. 4B, the divider 360 is separating the rear item 10B of the first stack 20 from the front item 10C of the second stack 30. Additional items 10 have been injected onto the second stack 30 rearward of the front item 10C. The item 10D is the next item being injected onto the second stack 30. Extension of the divider 360 into the extended position allows for separation of the first stack 20 from further incoming items 10. Separation of the first stack 20 allows for removal of the first stack 20, as described herein. It also allows for further items 10 to be injected into the same pocket 200 and for the second stack 30 to form behind the divider 360 and the first stack 20. In some embodiments, after the divider 360 has extended and the first stack 20 is completely formed, any further incoming items 10 may be diverted to another pocket 200. The divider 360 thus performs multiple functions that facilitate efficient sorting and removal of the items 10.

As further shown, items 10 may continue to be injected after the divider 360 is extended. Thus, the second stack 30 may begin to form and continue to form while the first stack 20 is separated from the second stack 30 and is available for further processing, such as for removal. The efficiency of the entire loading system 100 is thereby enhanced as items 10 may be removed from the pocket 200 while additional items 10 are injected into that same pocket 200. Thus, the pocket can be used simultaneously to remove the first stack 20 and to grow the second stack 30, without the need to stop sorting items to the pocket 200 or without interrupting the operation of the stacker 140. In this manner, injection of items 10 to a single pocket 200 may be continuous and the productivity of the pocket 200 enhance. The collective increased productivity of a plurality of the pockets 200 operated in this manner and over long periods of time produces much more efficient and productive sorting and loading of items 10 with the loading system 100.

In some embodiments, the second stack 30 may not form in the indicated pocket 200. The items in the second stack 30 may be diverted to a different pocket 200 by the loading system 100 or stacker 140. For example, before or after the divider 360 extends, that pocket 200 may cease to receive additional items until the first stack 20 is removed. Additional items 10 may instead by diverted to another pocket 200. The diverter 318 may be rotated in order to divert the items 10 to the other pocket 200. In some embodiments, information from the sensors, such as sensor 216A, 216B and/or 316, related to detection of the items 10 may be received by a control system that diverts the items 10 to another pocket 200 in response to such information, as is further described herein.

The paddle 220 is shown in FIG. 4B moved farther in the direction 9 as compared to FIG. 4A. In FIG. 4B, the size of the stack 20 has been increased for illustrative purposes to clearly show the movement of the paddle 220. The paddle 220 may be spring-loaded such that it maintains pressure on the front side of the first stack 20 as the stack 20 grows. When the paddle 220 moves to a particular location along the pocket 200, a sensor, such as the sensors 216A or 216B described with respect to FIG. 2, detects the paddle 220 and/or items 10. Detection of the paddle 220 and/or items 10 by the sensor can prompt the dividing system 350 to extend the divider 360 into the pocket 200. For example, the control system may be configured to extend the divider 360 when the first stack 20 reaches a threshold size indicating that the first stack 20 may be removed from the pocket 200.

The control system can extend the divider 360 for a variety of reasons. In some embodiments, the control system can extend the divider 360 based on the identity of the item 10 being injected or to be injected. For example, the first stack 20 can comprise items having a first distinguishing characteristic, such as a common destination, etc. When an item 10 having a different distinguishing characteristic, such as a destination other than the items 10 in the first stack 20, is identified, or is moving to or through the injector 300, the control system can extend the divider 360 to begin forming the second stack 30 with the item having the different destination. Thus, the second stack 30 begins to form against the divider 360, and the items from the first stack 20 and the second stack 30 are not in contact with each other or do not mix with each other. Further, this is just an example of the reasons for extending the divider, and other suitable reasons, such as other suitable distinguishing characteristics, may be employed.

After the divider 360 is extended, the first stack 20 can be removed from the pocket 200 and placed in a tray 400. The tray 400 may be supported by a carriage 500. In some embodiments, the tray 400 may be supported by other suitable means. The tray 400 and/or carriage 500 may couple with the edge 221 (see FIG. 4A) of the shelf 201. The tray 400 and carriage 500 may be similar to those described in U.S. patent application Ser. No. 14/869,843, filed Sep. 29, 2015, the entire contents of which are hereby incorporated by reference.

There is a channel 402 connecting the shelf 201 to the tray 400. The items 10 may move along the channel 402 from the pocket 2100 and into the tray 400. The first stack 20 may be removed in a variety of suitable manners. For example, the paddle 220 may rotate away from the pocket 200 in the direction 11 as indicated. Thus, the stack 20 could then be slid into the tray 400 from the pocket 200. In some embodiments, the first stack 20 may be grasped and removed from the pocket 200 by other equipment, such as the gripping system 450. Removal of the items from the pocket 200 and into the tray 400 may be controlled by a control system and performed in response to the sensors, such as sensors 216A or 216B, detecting a threshold amount and/or volume of items in the pocket 200, or in response to the characteristics of the items 10. Further details of a control system that may be used with the system 100 are provided herein, for example, with respect to FIG. 6. Alternatively or in addition, in some embodiments, the shelf 201 may be angled downward such that rotation of the paddle 220 allows the first stack 20 to fall into the tray 400 due to gravity.

Figure 4C:
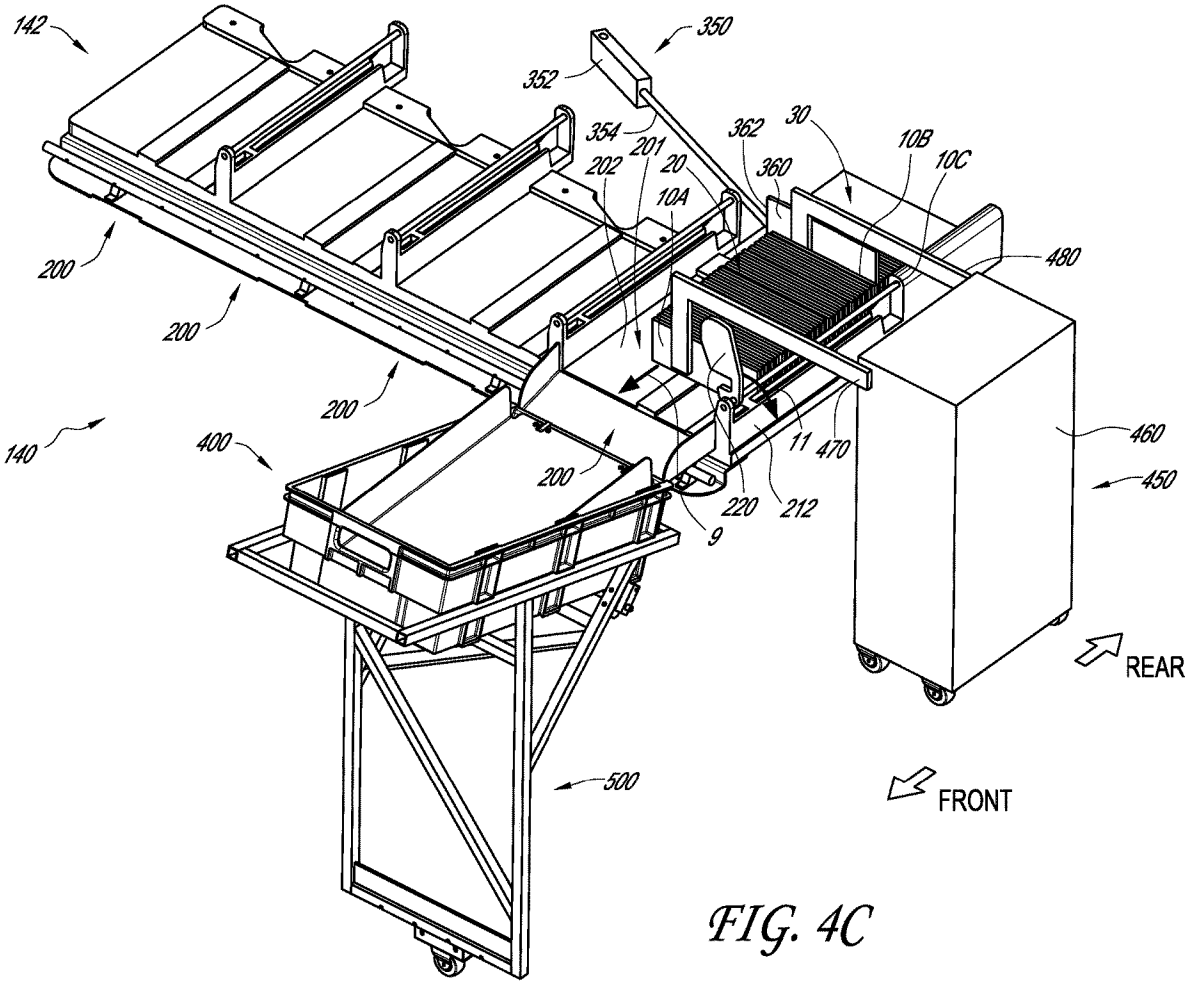
FIG. 4C is a perspective view of the stacker of FIGS. 4A and 4B showing an embodiment of a gripping system removing the first stack from the pocket using gripping elements on a robot.

FIG. 4C is a partial view of the stacker 140 showing an embodiment of the gripping system 450. The stacker 140 can be in the configuration shown in FIG. 4C at a later point in time as the configuration shown in FIG. 4B. As shown in FIG. 4C, the gripping system 450 is an industrial machine or mechanism, such as a robot or other suitable system. There may be one or more gripping systems 450. The gripping system 450 includes a body 460 coupled with a first gripping element 470 and a second gripping element 480. The gripping elements 470, 480 may be rotatably coupled with the body 460 such that the gripping elements 470, 480 may rotate or extend into the pocket 200.

The gripping elements 470, 480 may grip or otherwise retrieve the first stack 20. The first gripping element 470 contacts item 10A, which is the lead item in the first stack 20, or is the item 10 in contact with the paddle 220. The second gripping element contacts the rear item 10B by inserting itself between the rear item 10B and the divider 360. In some embodiments, the gripping elements 470, 480 may surround the first stack 20 and compress it slightly to get a grip on the stack 20. In some embodiments, rotation of the paddle 220 may be initiated based on detection that the gripping elements 470, 480 have gripped the first stack 20. This is just an example and the paddle 220 may be initiated for rotation based on a number of other suitable factors. As shown, the first gripping element 470 may contact the front item 10A and the second gripping element may contact the rear item 10B. The paddle 220 may be rotated in direction 11 as shown. In some embodiments, the first and second gripping elements 470, 480 can be articulated or comprise one or more joints controllable to grip the first stack 20. The paddle 220 and/or the divider 360 may have features to facilitate insertion of the first and second gripping elements 470, 480 about the first stack 20. For example, the paddle 220 and/or divider 360 may have grooves, slots or other openings (not shown), other suitable features, or combinations thereof, which may allow the gripping elements 470, 480 to surround the front and rear ends of the first stack 20.

Figure 4D:
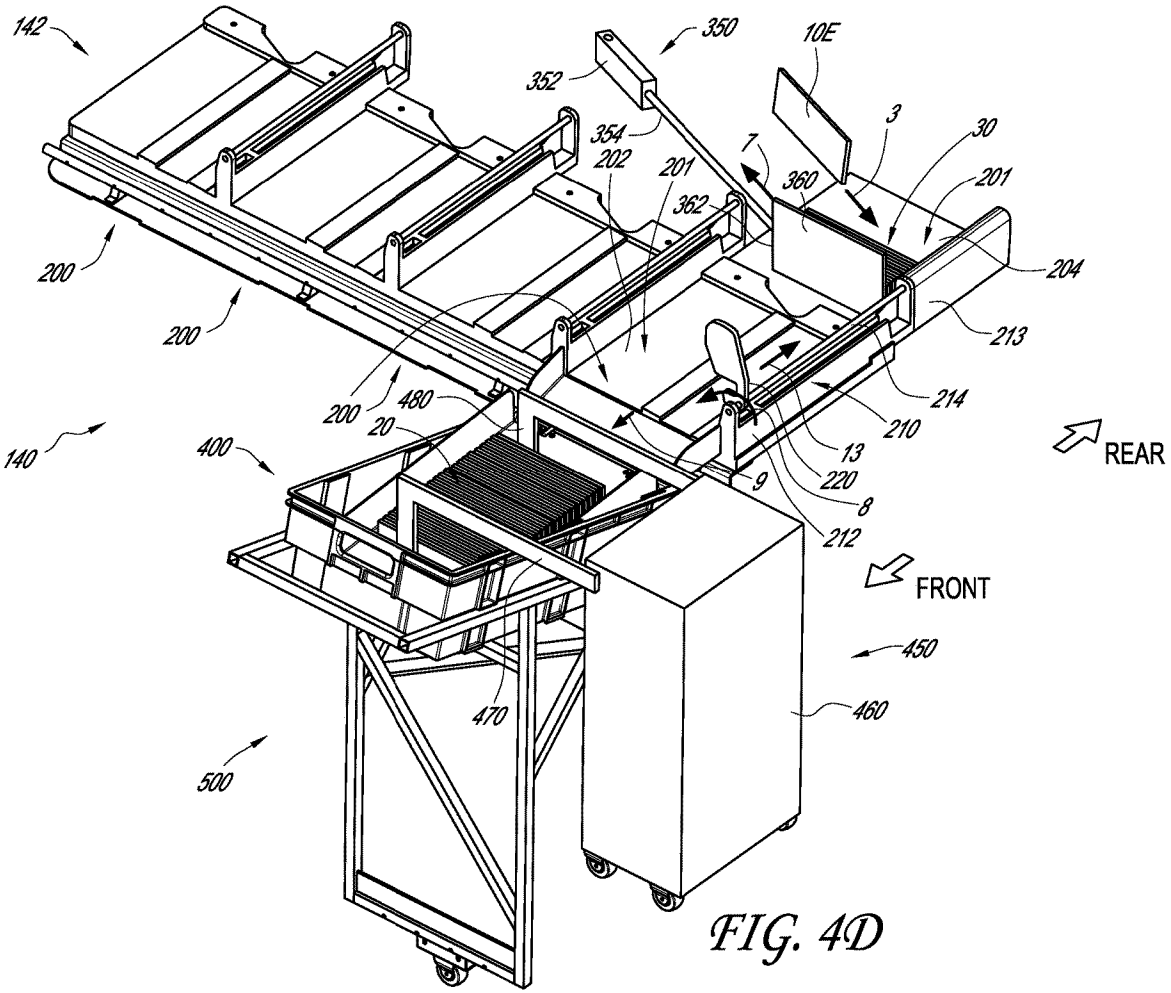
FIG. 4D is a perspective view of the stacker of FIGS. 4A to 4C showing the gripping system of FIG. 4C placing the first stack into the carriage and tray system of FIGS. 4B and 4C.

FIG. 4D is a partial view of the stacker 140 showing the gripping system 450 placing the first stack 20 into the tray 400. The stacker 140 can be in the configuration shown in FIG. 4D at a later point in time as the configuration shown in FIG. 4C. As shown in FIG. 4D, the gripping elements 470, 480 slide the first stack 20 toward the tray 400 and release the stack 20 in the tray 400. In some embodiments, the gripping elements 470, 480 may remove the first stack 20 by lifting or rotating the first stack 20 out of the pocket 200 and then placing the stack 20 into the tray 400 by rotating the gripping elements 470, 480 toward and into the tray 400. The tray 400 may be used for transport, for example for further processing or delivery, of the sorted stack 20 of items 10. If the paddle 220 has been rotated upward, the paddle 220 may rotate in the downward direction 8 as indicated. The paddle 220 may move in the direction 13 toward the rear in order to receive the second stack 30 of items 10. The divider 360 may be retracted in the direction 7 as indicated so that the paddle 220 may contact the second stack 30.

In some embodiments, the gripping system 250 may have only a single gripping element, which can insert between the rear article 10B and the divider 360, and then push the first stack 20 into the channel 402 and into the tray 400, after the paddle 220 has moved away from the front item 10A.

As further shown, items 10 continue to be injected before, during and/or after the first stack 20 is removed from the stacker 140. Thus, the second stack 30 may begin to form and continue to form while the first stack 20 is being processed. Thus the productivity of the entire loading system 100 is enhanced. The pocket 200 being unloaded into the tray 400 can still be designated to receive items 10 from the injector during the pocket unloading. If the pocket 200 was unavailable during unloading, items intended for the pocket 200 would need to be routed to another pocket 200, and thus two pockets 200 in the stacker 140 would be in use for a single destination or route. This leaves fewer pockets 200 available to receive items 10 intended for other destinations or routes, and improves the utilization of the stacker 140.

Figure 4E:
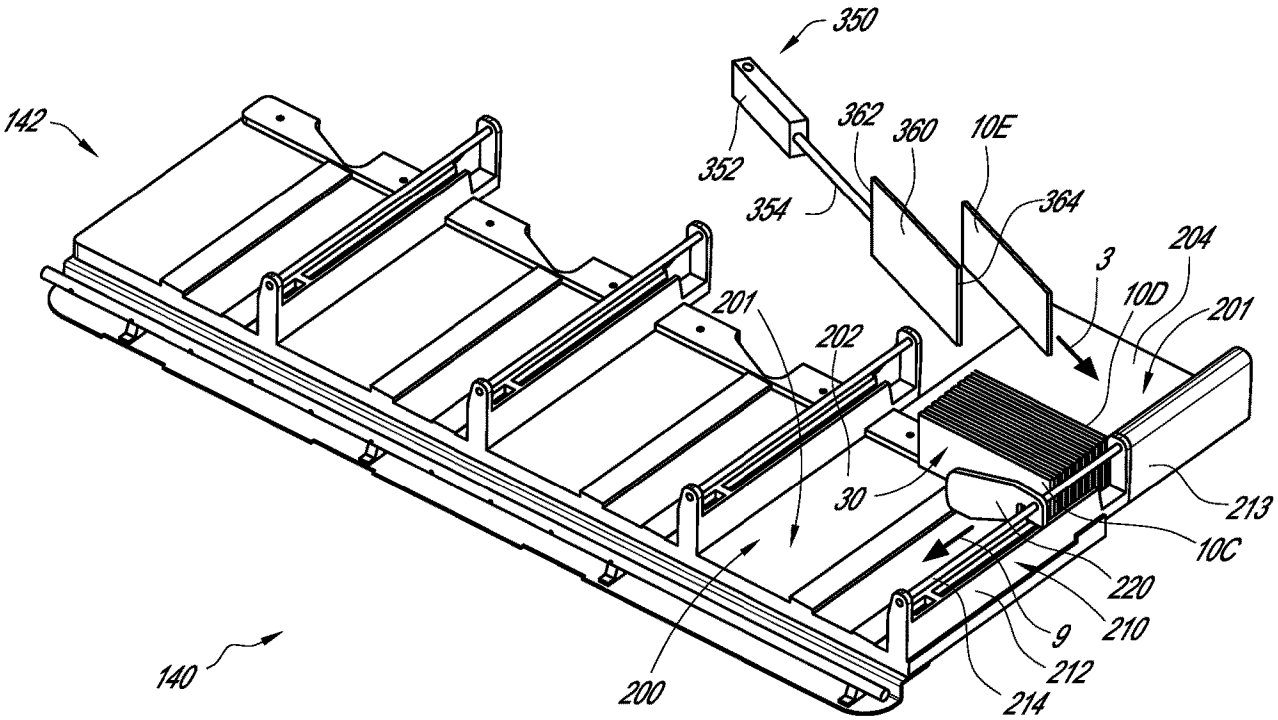
FIG. 4E is a perspective view of the stacker of FIGS. 4A to 4D showing the divider in the retracted position and the second stack of FIG. 4B contacting the paddle.

FIG. 4E is a schematic of the stacker 140 showing the first stack 20 removed, the divider 360 in the retracted position, the paddle 220 moved rearward relative to the position shown in FIG. 4D, and the second stack 30 now contacting the paddle 220. The stacker 140 can be in the configuration shown in FIG. 4E at a later point in time as the configuration shown in FIG. 4D, and after the first stack 20 has been unloaded into the tray 400. An additional item 10E is injected onto the rear of the second stack 30. Because the first stack 20 has been removed, the second stack 30 is now the front stack of items 10. Thus, the second stack 30 may now be processed in the same manner as the first stack 20 as described with respect to FIGS. 4A-4D. A third stack (not shown) may then form behind an extended divider 360 behind the second stack 30 (which has now become the front stack) and be processed in the same manner as the second stack 30 as described with respect to FIGS. 4A-4E, etc.

Figure 5A:
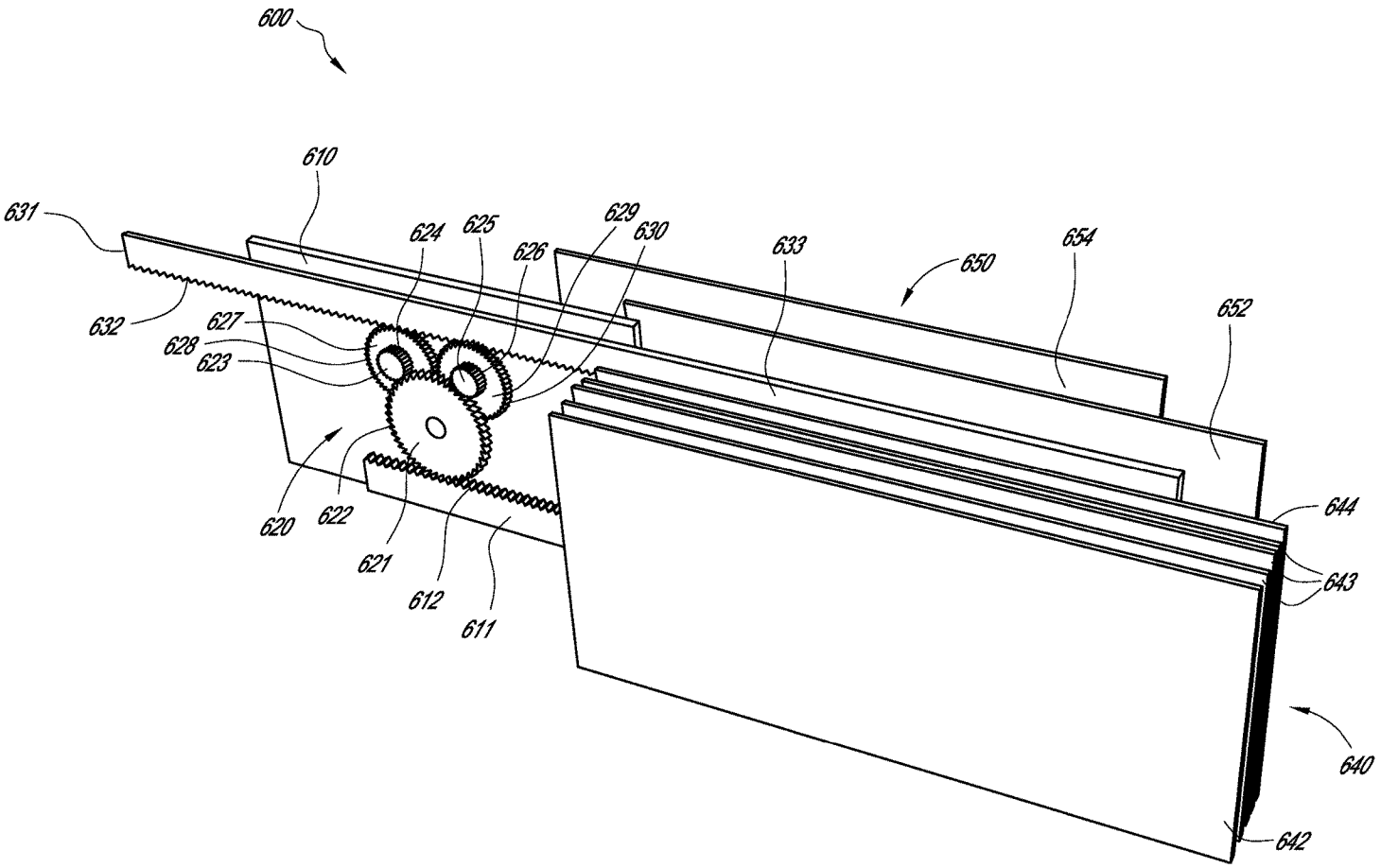
FIGS. 5A and 5B are perspective views of embodiments of a progressive displacement divider system that may be used with the various loading systems described herein.
Figure 5B:
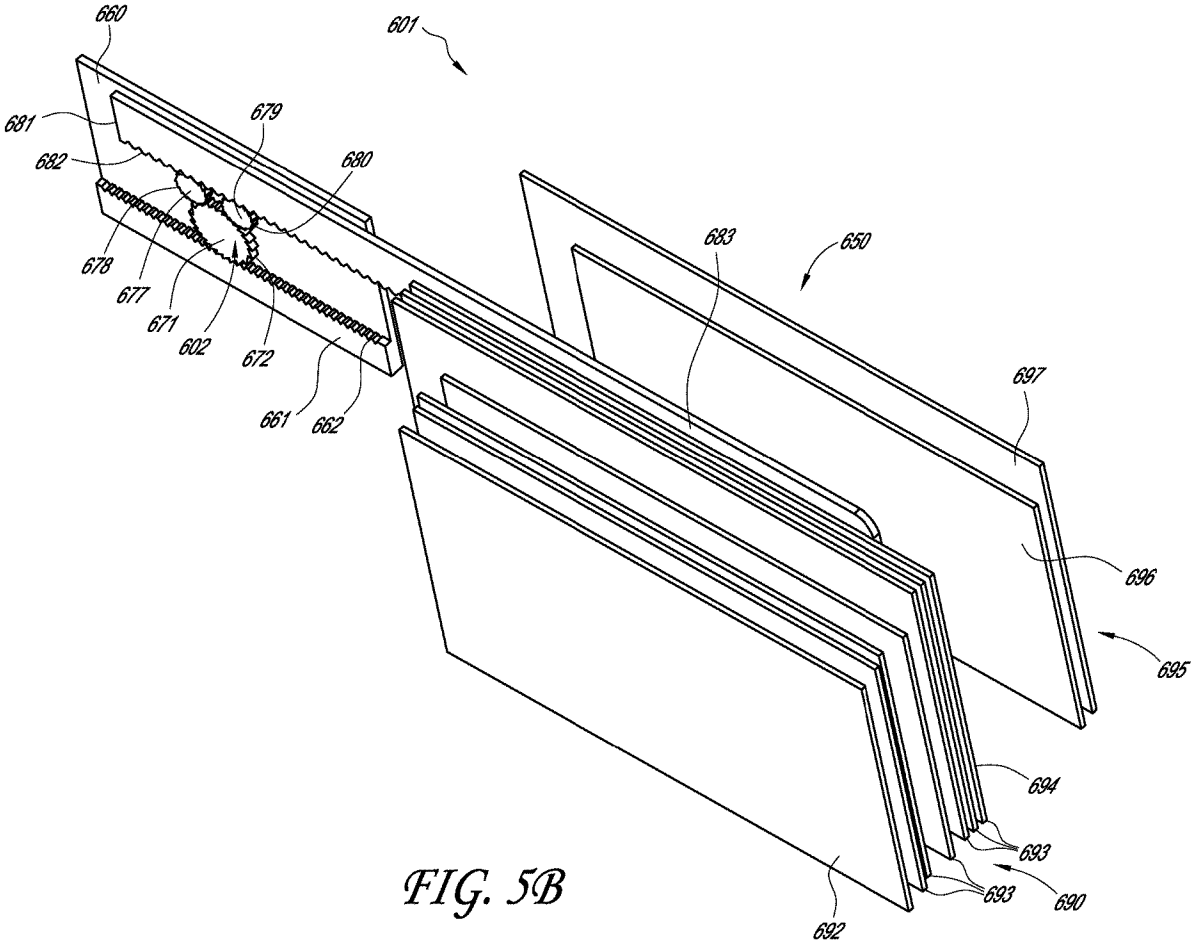

FIGS. 5A and 5B are perspective views of embodiments of progressive displacement divider systems 600, 601 that are used with the various loading systems described herein. The systems 600, 601 are used with the injector 300. The systems 600, 601 may have the same or similar features and/or functionalities as the divider system 350, and vice versa. The systems 600, 601 may be electromechanical drive systems that coordinate insertion of the divider 360 with an incoming item 10, for example to reduce or eliminate the likelihood of a jam between the divider 360 and the items 10. The systems 600, 601 generate a greater extension of the divider 360 for a given electromechanical input.

As shown in FIG. 5A, the system 600 includes a support 610. The support 610 may be coupled with the injector 300, for example with the injector support 302.

The system 600 includes a first linear member 611. The linear member 611 is moveably coupled to the support 610 via a track, slot, or other similar mechanism that allows the linear member 611 to translate linearly as described while being retained on the support 610. The linear member 611 has teeth 612 for engaging a gear system 620. The teeth 612 may be located along an edge of the linear member 611. The linear member 611 moves, for example, linearly, and is the drive member of the system 600. The motion of linear member 611 is amplified by the gear system 620, as described below, causing a divider 631 to move farther and/or at a higher rate, as described below. The linear member 611 may be caused to move by an actuator (not shown), such as the actuator 352, other actuators described herein, or by other suitable movement means.

The system 600 includes the gear system 620. The gear system 620 is coupled with the support 610. The gear system 620 may include one or more gears rotatably coupled with the support 610. As shown, the gear system 620 includes a first gear 621, a second gear 623, and a third gear 625. The first gear 621 has teeth 622 located along the perimeter of the gear 621. The teeth 622 may engage with the teeth 612 of the linear member 611. Movement of the linear member 611 causes the gear 621 to rotate. For example, movement of the linear member 611 to the right as oriented causes the gear 621 to rotate counterclockwise as oriented. Movement of the linear member 611 to the left as oriented may cause the gear 621 to rotate clockwise as oriented.

The second and third gears 623, 625 are rotatably coupled with the support 610 adjacent the first gear 621. The second gear 623 has a smaller diameter than the first gear 621. The second gear 623 has teeth 624 located along the perimeter of the gear 623. The teeth 624 of the second gear 623 engage with the teeth 622 of the first gear 621. The second gear 623 is fixedly coupled with a larger diameter second gear portion 627. The second gear portion 627 has a larger diameter than the second gear 623. As shown, the second gear 623 is attached concentrically with the second gear portion 627. The second gear 623 and second gear portion 627 may be a monolithic piece. The second gear portion 627 has teeth 628 located along the perimeter of the second gear portion 627.

The third gear 625 has teeth 626 located along the perimeter of the gear 625. The third gear 625 may have a smaller diameter than the first gear 621. The second gear 623 and the third gear 625 may have the same diameter. The teeth 626 of the third gear 625 engage with the teeth 622 of the first gear 621. The third gear 625 is fixedly coupled to a larger diameter third gear portion 629. The third gear portion 629 may have a larger diameter than the third gear 625. As shown, the third gear 625 is attached concentrically with the third gear portion 629. The third gear 625 and third gear portion 629 may be a monolithic piece. The third gear portion 629 has teeth 630 located along the perimeter of the third gear portion 629. In some embodiments, the second and third gears 623, 625 may be identical parts.

The first gear 621 engages with the second and third gears 623, 625. Movement of the linear member 611 causes the first gear 621 to rotate which then rotates the second and third gears 623, 625. For example, movement of the linear member 611 in a first direction causes the gear 621 to rotate counterclockwise as oriented. Movement of the linear member 611 in a second direction opposite the first direction may cause the gear 621 to rotate clockwise as oriented. Movement of the gear 621 causes the second and third gears 623, 625 to rotate. For example, rotation of the gear 621 in the counterclockwise direction as oriented causes the second and third gears 623, 625 to rotate clockwise as oriented. Rotation of the gear 621 in the clockwise direction as oriented may cause the second and third gears 623, 625 to rotate counterclockwise as oriented.

The system 600 includes a divider 631. The divider 631 may have the same or similar features and/or functionalities as the other dividers described herein, for example the divider 360, and vice versa. The divider 631 is an elongated structural member made of metal, plastic, polymer, other suitable materials, or combinations thereof. The divider 631 has a first end 633 that separates two stacks of items when the divider 631 is extended. The first end 633 is a portion or region of the divider 631 that extends at or near the rear of the first stack of items and, upon injecting a second stack of items, separates the first and second stacks of items. The divider 631 has teeth 632 located along an edge of the divider 631. The teeth 632 engage with the various teeth of the various gears to induce movement of the divider 631. The teeth 632 engage with the teeth 628 of the large diameter portion 628 of the second gear 623. The teeth 632 may engage with the teeth 630 of the large diameter portion 629 of the third gear 625. Rotation of the second and third gears 623, 625 causes the divider 631 to move, for example to extend or retract. For instance, rotation of the second and third gears 623, 625 in the clockwise direction causes the divider 631 to extend, i.e. move in the first direction. Rotation of the second and third gears 623, 625 in the counterclockwise direction may cause the divider 631 to retract, i.e. move in the second direction.

The gear system 600 provides a mechanical advantage whereby an input movement to the system 600, such as an input movement by the linear member 611, is amplified and results in a larger output movement of the divider 631 as compared to the input movement. For example, movement of the linear member 611 a distance of X may result in movement of the divider 631 a distance of 2X. This is merely an example, and other amplifications and/or mechanical advantages may be implemented. The resulting mechanical advantages are determined based at least in part on the relative diameters of the various gears 621, 623, 625 and the number and size of the teeth 622, 624, 626, 628, 630 and 632. The mechanical advantage provided by the gear system 600 allows for less input actuation, with resulting savings in power, time and cost. For instance, the shaft 354 of the divider system 350 may be used as the linear member 611. The shaft 354 would therefore not be required to move as far for a given translation of the divider 360, with corresponding savings in power, etc. The gear system 600 also provides for space savings. Less physical space is required for a divider system 350 having the gear system 600 incorporated. For example, if the gear system 600 were incorporated into the divider system 350 of FIGS. 4A-4E, the shaft 354 would not need to move as far with the amplified output movement of the divider 360.

The divider 631 is inserted into a pocket 200 (as described elsewhere herein) to separate stacks of items. The divider 631 extends to divide the stack 640 from the stack 650. The stacks 640 and 650 may have the same features and/or functionalities as the various stacks described herein, for example the stacks 20 and 30 respectively, and vice versa. As shown, the stack 640 includes a front item 642, one or more intermediate items 643, and a rear item 644. The front item 642 may have the same or similar features and/or functionalities as the front item 10A, and vice versa. The rear item 644 may have the same or similar features and/or functionalities as the rear item 10B, and vice versa. The stack 650 includes a front item 652 and a rear item 654. The stack 650 may also include intermediate items in between the front item 652 and the rear item 654. The front item 652 may have the same or similar features and/or functionalities as the front item 10C, and vice versa. The rear item 654 may have the same or similar features and/or functionalities as the rear item 10D, and vice versa.

FIG. 5B shows another embodiment of a progressive displacement gear system 601. The system 601 may have the same or similar features and/or functionalities as the gear system 600, and vice versa. As shown in FIG. 5B, the system 601 includes a support 660. The support 660 may have the same or similar features and/or functionalities as the support 610.

The system 601 includes a first linear member 661. The linear member 661 may have the same or similar features and/or functionalities as the linear member 611. The linear member 661 moves, for example linearly, and is the drive member of the system 601. The motion of linear member 661 is amplified by a gear system 602 that includes the first gear 671, a second gear 677 and a third gear 679, as described below, causing a divider 681 to move farther and/or at a higher rate, as described below. The linear member 661 may be caused to move by an actuator, such as the actuator 352, other actuators described herein, or by other suitable movement means. The linear member 661 has teeth 662 for engaging a first gear 671. The teeth 662 may be located along an edge of the linear member 661.

The gear system 602 includes the first gear 671. The first gear 671 may have the same or similar features and/or functionalities as the first gear 621. The first gear 671 is rotatably coupled with the support 660. The first gear 671 has teeth 672 located along the perimeter of the gear 671. The teeth 672 may engage with the teeth 662 of the linear member 661. Movement of the linear member 661 causes the gear 671 to rotate, as described above.

The second gear 677 and third gear 679 may have the same or similar features and/or functionalities respectively as the second and third gears 623, 625. The second and third gears 677, 679 are rotatably coupled with the support 660 adjacent the first gear 671. The second and third gears 677, 679 may each have a smaller diameter than the first gear 671. The second and third gears 677 and 679 have, respectively, teeth 678 and 680 located along the perimeters of the gears. The teeth 678 and 680 may engage with the teeth 672 of the first gear 671. In some embodiments, the second and third gears 677, 679 may be identical parts.

The system 601 includes a divider 681. The divider 681 may have the same or similar features and/or functionalities as the other dividers described herein, for example the dividers 360 or 631, and vice versa. The divider 681 has a first end 683 that separates two stacks of items when the divider 681 is extended. The first end 683 is a portion or region of the divider 681 that extends at or near the rear of the first stack of items and, upon injecting a second stack of items, separates the first and second stacks of items. The divider 681 has teeth 682 located along an edge of the divider 681. The teeth 682 may engage with the teeth 678, 680 of the second and third gears 677, 679. Rotation of the second and third gears 677, 679 causes the divider 681 to move, for example to extend or retract, as described above. Thus, rotation of the second and third gears 677, 679 engages directly with the divider 681. The gear system 602 provides a mechanical advantage, as described above, whereby an input movement to the system 650 is amplified and results in a larger output movement of the divider 681 as compared to the input movement.

The divider 681 is inserted into the pocket 200 (described above) to separate stacks 690 and 695 of items. The divider 681 may have the same or similar features and/or functionalities as the divider 631 described above. The first stack 690 includes a front item 692, intermediate items 693, and a rear item 694. The second stack 695 includes a front item 696 and a rear item 697. The first and second stacks 690, 695 may have the same or similar features and/or functionalities as the first and second stacks 640, 650.

Figure 6:
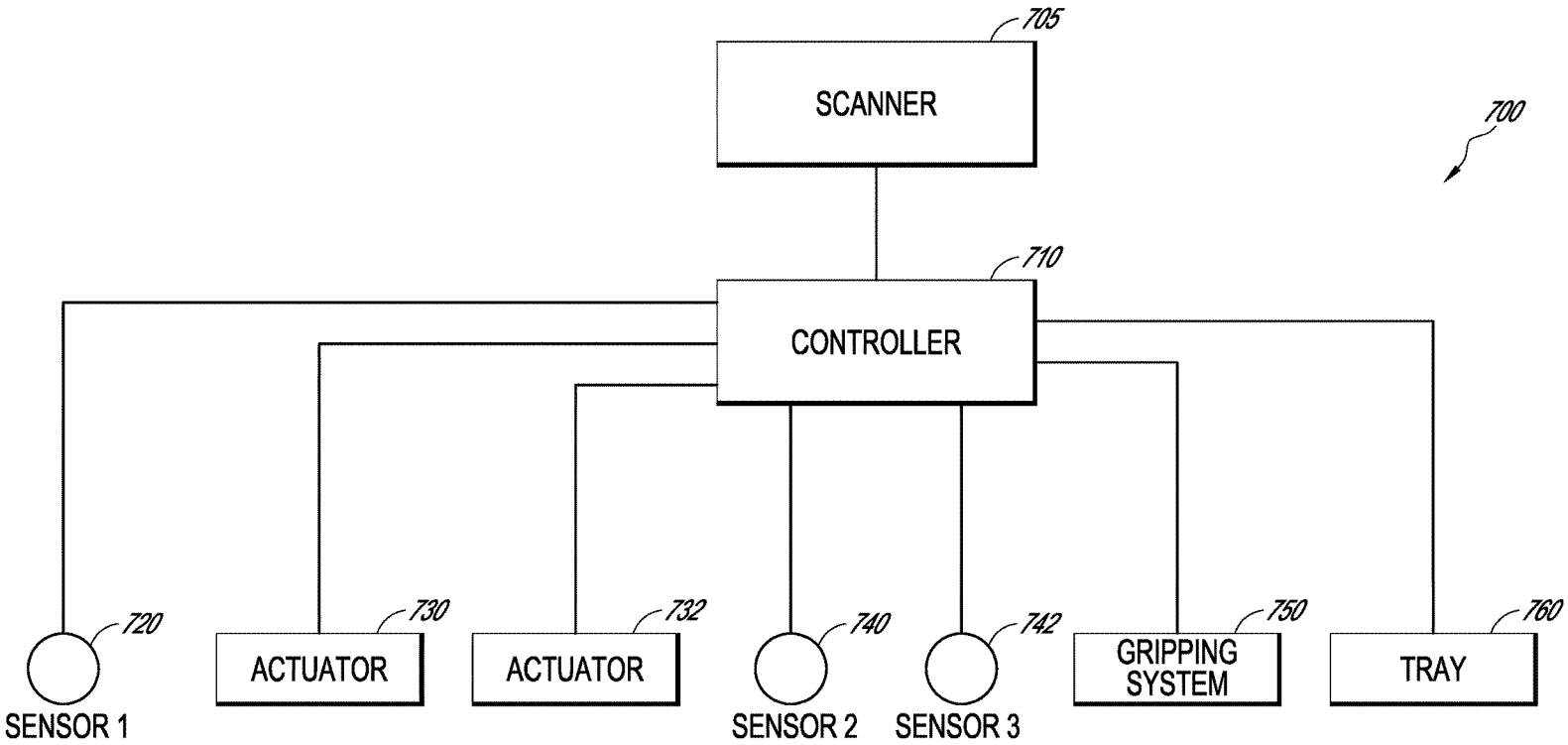
FIG. 6 is a block diagram of a control system that may be used to control the various loading systems described herein.

FIG. 6 is a schematic of a control system 700 that is used to control the various systems described herein, such as the loading system 100, stacker 140 and/or injector 300. As shown, the system 700 includes a controller 710. The controller 710 includes or is in electrical communication with the various sensors and devices described herein for control of the item sorting process. The controller 700 can include one or more processors, a server, a microcontroller, or other computing device, a memory storing operating instruction for controlling operation of the equipment described herein, communication modules, and other electronic components. As shown, the controller 710 is coupled (e.g., in electrical communication) with a scanner 705, a first sensor 720, a first actuator 730, a second actuator 732, a second sensor 740, a third sensor 742, a gripping system 750, and a tray 760. The communication may be wired or wireless. The scanner 705 is part of the intake system 120, as described herein. For example, the scanner 705 may scan an incoming item or items for information related to destination, size, priority, etc. and the controller 710 may receive this information from the scanner 705 to appropriately control the system. In some embodiments, the scanner 705 may, in addition or alternatively, be part of another part or parts of the system, such as the injector 300, etc.

The first, second and/or third sensor 720, 740, 742 correspond to the various sensors described herein, such as the sensor 216A, 216B or 316. The first and/or second sensor 720, 740 may detect information related to the sorting of items, such as the presence of the items 10, the distinguishing characteristic of the item 10 such as destination, etc., or other suitable information. This information is communicated to the controller 710 for analysis and/or control of the other parts of the system, such as the first actuator 730, the second actuator 742, the gripping system 750 and/or the tray 760. For example, the first sensor 720 may be a sensor in the intake system 120 or sorter system 130 that detects the presence of the item 10 and/or a distinguishing characteristic of the item 10, such as destination, etc. As a further example, the control system 700 in response may send a command to the actuator 730 or 732, which may be an actuator to actuate the diverter gate 318, to divert the item 10 to a particular pocket 200. The second sensor 740 may be the sensor 316 in the injector 300 that detects the item 10 travelling along the direction 1 (shown in FIG. 2). The control system 700 in response may send a command to an actuator 730 or 732 to actuate the divider system 350, thereby extending the divider 360 into the pocket 200 to divide the item 10 from the first stack 20. The third sensor 742 may be the first or second pocket sensor 216A, 216B that detects the items 10 and/or paddle 220 in the pocket 200. (See FIG. 3). The control system 700 in response may send a command to the gripping system 750 to move the stack 20 from the pocket 200 to the tray 400. Further, in some embodiments there may only be one or two of the sensors 720, 740, 742, or there may be more than the three sensors 720, 740, 742.

The control system 700 is in electrical communication with the first actuator 730 and/or the second actuator 732. In some embodiments, there may only be one of the actuators 730, 732, or there may be more than the two actuators 730, 732. The actuators 730, 732 control movement of a part or parts of the system 100. For example, the first actuator 730 may be the actuator 352 described herein. Thus, the first actuator 730 may control movement, for example extending and/or retracting, of the divider 360. As another example, the second actuator 732 may control the movement, for example translation and/or rotation, of the paddle 220. As another example, the actuator 730 and/or 732 may alternatively or instead control the movement, for example translation and/or rotation, of the gripping system 450 and/or portions thereof, such as the gripping elements 470, 480. These controls may be in response to information based on detecting various characteristics with the sensors 720, 740, 742, as described above. Alternatively, the gripping system 450, such as the gripping system 750, may be controlled independently of the actuators 730, 732 as described below.

The controller 710 is in communication with the gripping system 750. The gripping system 750 includes various actuators, members, etc. that are controllable by the controller 710. The gripping system 750 may have the same or similar features and/or functionalities as the gripping system 450. The control system 700 may control movement, for example locomotion of the gripping system 750. The control system 700 may control portions of the gripping system 750. For example, the control system 700 may control rotation or other movement of gripping elements of the gripping system 750, such as the gripping elements 470, 480 of the gripping system 450. The controller 710 may thus command the gripping system 750 to move to a particular pocket 200 and to remove the stack 20 of items 10 from that pocket 200.

The control system 700 is in communication with tray 760. In some embodiments, the control system 700 may not include the tray 760. The tray 760 may have the same or similar features and/or functionalities as the tray 400 or associated components such as the carriage 500. The control system 700 may control movement, for example locomotion, of the tray 400 and/or carriage 500. For example, the controller 710 may command the carriage 500 to move to a particular pocket 200. The control system 700 may control portions of the tray 400 and/or carriage 500. For example, the control system 700 may control movement of portions of the tray 400 such that the tray 400 is configured to receive the items 10 from the pocket 200. Movement of the tray 760 may be in response to detecting various characteristics with the sensors 720, 740, 742, as described above. For example, the sensor 720 may detect items 10 intended for a particular pocket 200, and in response the control system 700 may send a command for the tray 400 to move to that pocket 200 for receipt of the items 10.

Figure 7A:
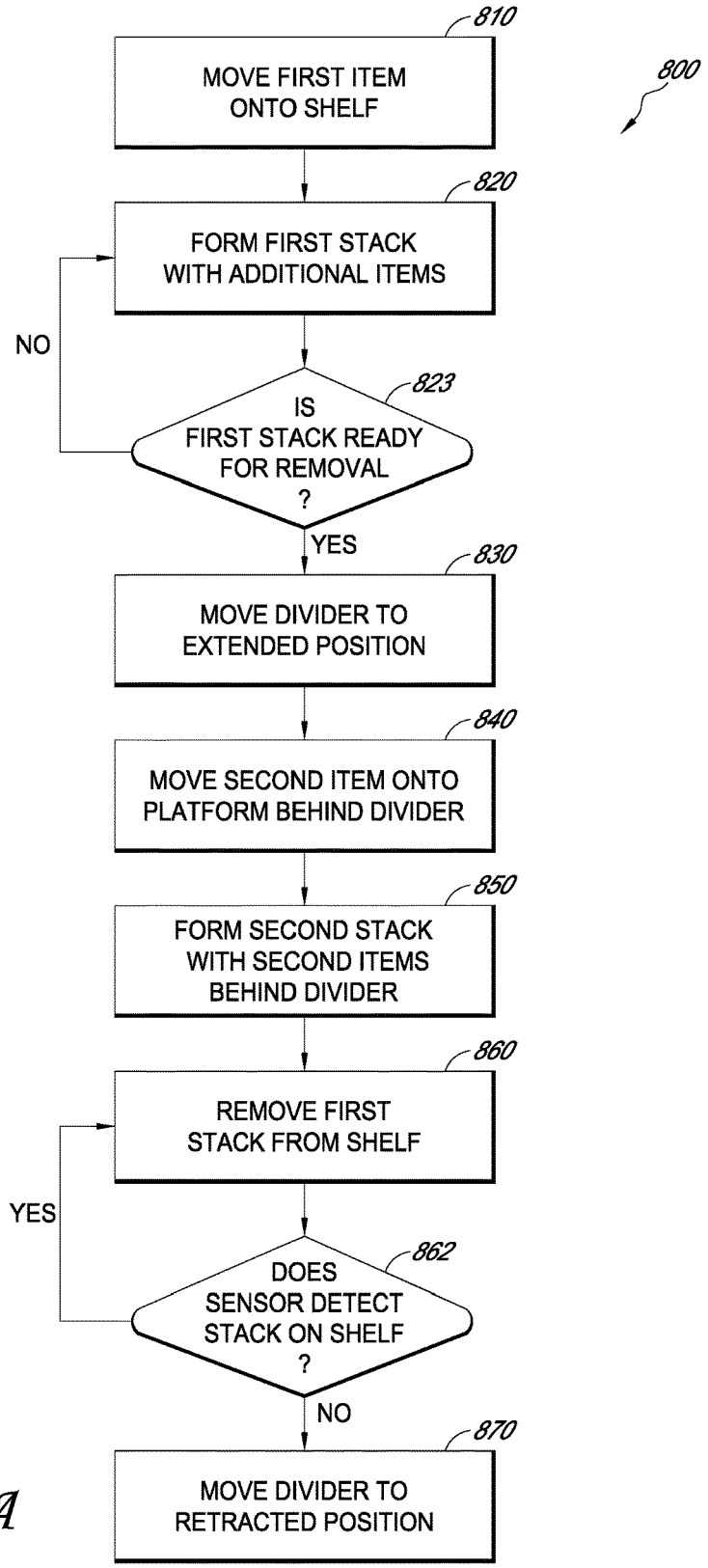
FIG. 7A is a flowchart showing an embodiment of a method for sorting items that may be performed by the various loading systems described herein.

FIG. 7A is a flowchart showing an embodiment of a method 800 for sorting items that may be performed by the various systems described herein. The method 800 may be performed by the loading system 100, the stacker 140, the injector 300, the pocket 200, portions thereof, or combinations thereof. FIGS. 7B to 7G are flowcharts showing embodiments of methods for performing the steps of method 800.

As shown in FIG. 7A, the method 800 begins with step 810 wherein a first item is moved onto a shelf. The various items and shelves described herein may be used in step 810. For example, in step 810 the item 10A is injected into the pocket 200 on the shelf 201.

The method 800 then moves to step 820 wherein the first stack 20 is formed as one or more items 10 are injected into the pocket 200 on the shelf 201 behind the item 10A to form the first stack 20. Step 820 may also include rear item 10B being injected onto the first stack 20.

The method 800 then moves to decision state 823 wherein it is determined if the first stack 20 is ready for removal from the pocket 200. In decision state 823 the sensor 216A or 216B detects the items 10 or paddle 220 at a particular location of or distance within the pocket 200. In some embodiments, in decision state 823 it is determined that the first stack 20 is ready for removal if the sensor 316 detects a specific number of items 10 has passed through the injector 300. In some embodiments, in decision step 823 it is determined that the first stack is ready for removal if the sensor 216A detects the items 10 in the first stack and if the sensor 216B detects the paddle. In some embodiments, in decision step 823 it is determined that the first stack is ready for removal if a particular characteristic of incoming items has been detected, such as destination, size, other characteristics, or combinations thereof. For example, the first stack 20 may be ready for removal when subsequent items, having different characteristics, such as a different delivery destination or assigned route, from the items 10 already in the first stack 20, are detected at the sensor 316, or when the sorter 130 knows an item 10 having a different destination is to be injected into a pocket 200. Thus various approaches may be taken to determine whether the first stack is ready for removal in decision step 823.

If it is determined in decision step 823 that the first stack is not ready for removal, the method 800 then returns to step 820 to further grow the stack with items.

If it is determined in decision state 823 that the first stack is ready for removal, the method 800 then moves to step 830 wherein the divider 360 is extended by the divider system 350 into the pocket 200. In some embodiments, the divider 360 may be extended in step 830 to the positions shown in FIGS. 4B to 4D. As another example, step 830 may include the divider 631 or 681 extended respectively by the progressive displacement system 450 or 650 adjacent the stack 640 or 690.

The method 800 then moves to step 840 wherein the item 10C is injected into the pocket 200 on the shelf 201 behind the extended divider 360.

The method 800 then moves to step 850 wherein one or more items 10 are injected into the pocket 200 behind the item 10C form the second stack 30. Step 850 may also include rear item 10D being injected onto the second stack 30.

The method 800 then moves to step 860 wherein the first stack is removed from the shelf. The various stacks, shelves and gripping systems described herein may be used in step 860. For example, step 860 may include the gripping system 860 removing the first stack 20 from the shelf 201.

The method 800 then moves to decision step 862 wherein it is whether the sensor 216A or 216B detects the stack 20 or 30 on the shelf 201. If the a stack is detected on the shelf 201 by the sensor 216A or 216B, the method 800 moves back to step 860 for removal of the stack 20.

If in step 862 the sensor does not detect the stack of items 10 or paddle 220, the method 800 moves to step 870, wherein the divider 360 is retracted by the divider system 350 out of the pocket 200. In some embodiments, the divider 360 may be retracted in step 870 to the positions shown in FIG. 4A or 4E. As another example, in step 870 the divider 631 or 681 is retracted respectively by the progressive displacement system 450 or 650 away from the stack 650 or 695.

Figure 7B:
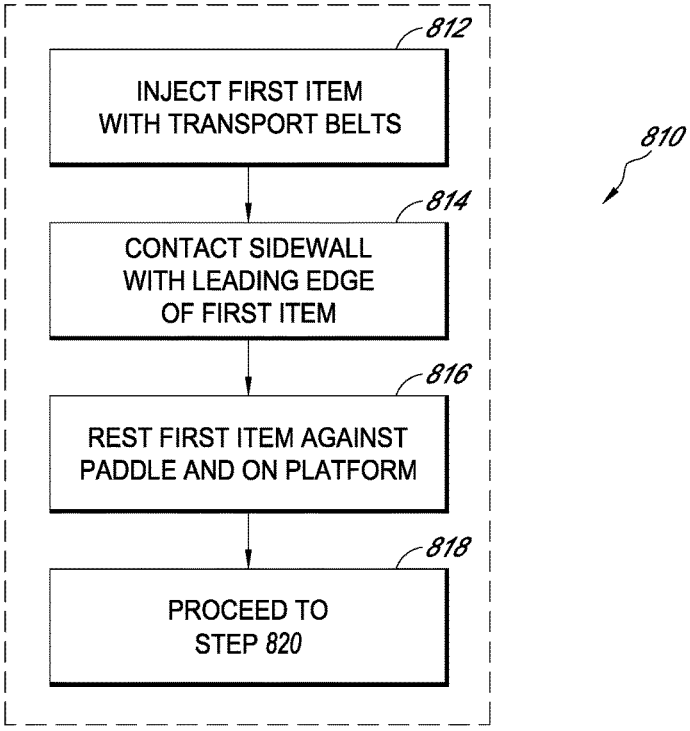
FIG. 7B is a flowchart of an embodiment of a method for moving a first item into a pocket that may be used with the method of FIG. 7A.

FIGS. 7B to 7G are flowcharts showing embodiments of methods for performing the steps of method 800. FIG. 7B is a flowchart of an embodiment of the step 810. As shown, the step 810 begins with the sub-step 812 wherein a first item is injected via the belts 314 and 322 of injector 300 inject the item 10A into the pocket 200. The diverter 318 may also actuate in sub-step 812 to divert the item 10A along the direction 1 for insertion along the direction 3. The step 810 then continues with sub-step 814 wherein the item 10A contacts the rear wall portion 213 in the pocket 200.

The step 810 then continues with sub-step 816 wherein the item 10A comes to rest on the shelf 201 and against the paddle 220. The step 810 then moves to sub-step 818, where the method 810 moves to step 820 of FIG. 7A and performs as described herein.

Figure 7C:
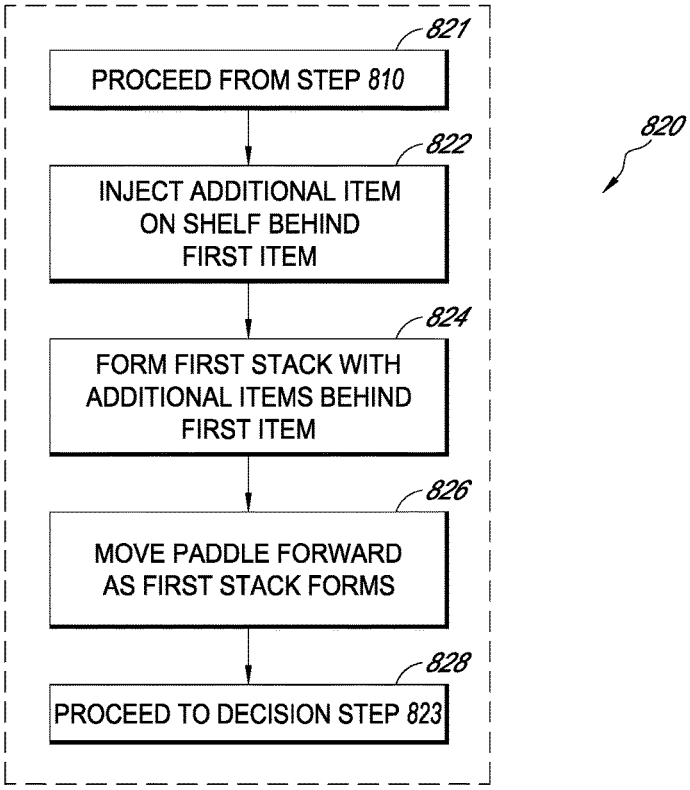
FIG. 7C is a flowchart of an embodiment of a method for forming a first stack that may be used with the method of FIG. 7A.

FIG. 7C is a flowchart of an embodiment of the step 820. As shown, the step 820 begins with sub-step 821 where it proceeds from step 810. Sub-step 821, and similar "proceed from" sub-steps described herein, are for purposes of clarity to show that the sub-steps may be performed as part of a larger, overall method. For instance, FIG. 7C is an embodiment of step 820 that may be a part of the larger, overall method 800.

The step 820 continues with the sub-step 822 wherein an additional item is injected onto the shelf behind the first item. For example, in step 820 one or more of the items 10 are injected by injector 300 onto the shelf 201 behind the item 10A. The step 820 then continues with sub-step 824 wherein a first stack is formed with the additional items behind the first item. For example, in step 820 the rear item 10B may be injected by the injector 300 against the additional items 10 to form the first stack 20.

Step 820 then continues with sub-step 826 wherein the first stack 20 grows and pushes the paddle 220 forward. In some embodiments, the paddle 220 is moved forward by a motor or actuator to accommodate the received items 10 in the first stack 20. In some embodiments, the paddle 220 is spring-loaded so that in sub-step 826 the paddle 220 maintains contact with the first stack 20 as the paddle 220 moves. In some embodiments of sub-step 826, the actuator 730 may be used to move the paddle 220, which may be moved incrementally in discrete amounts or continuously as items 10 are injected into the pocket 200 and against the paddle 220. The items 10 may exert a force on the first stack 20 that causes the paddle 220 to move. In some embodiments, the shelf 201 may be angled such that gravity causes or facilitates the movement of the paddle 220 with the first stack 20 as the first stack 20 grows and pushes on the paddle 220.

The step 820 then continues to sub-step 828 where the step 820 proceeds to decision step 823 of FIG. 7A and performs as described elsewhere herein.

Figure 7D:
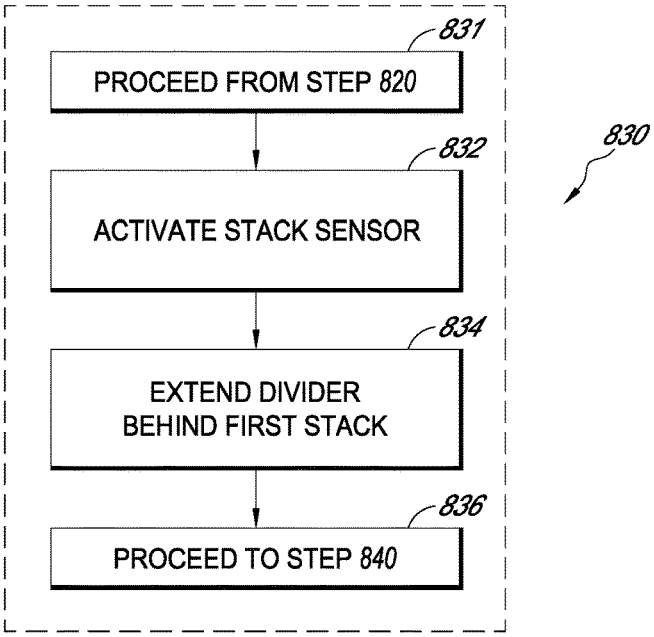
FIG. 7D is a flowchart of an embodiment of a method for extending a divider that may be used with the method of FIG. 7A.

FIG. 7D is a flowchart of an embodiment of the step 830. As shown, the step 830 begins with sub-step 831 where it proceeds from step 820. The step 830 continues with the sub-step 832 wherein the sensors 216A or 216B detect the presence of the stack 20 or 30 of the items 10 and/or the presence of the paddle 220. Sub-step 832 may also include detection of items 10 in the injector 300, for example with the sensor 316. In some embodiments, in sub-step 830 the sensors 720 and/or 740 detect the items 10 or paddle 220.

The step 830 then continues to sub-step 834 where a divider is extended behind the first stack. For example, the divider 360 may be extended behind the first stack 20 by the actuator 352, as described herein. The step 830 then continues to sub-step 836 where the method 830 proceeds to sub-step 840 of FIG. 7A or 7E and performs as described herein.

Figure 7E:
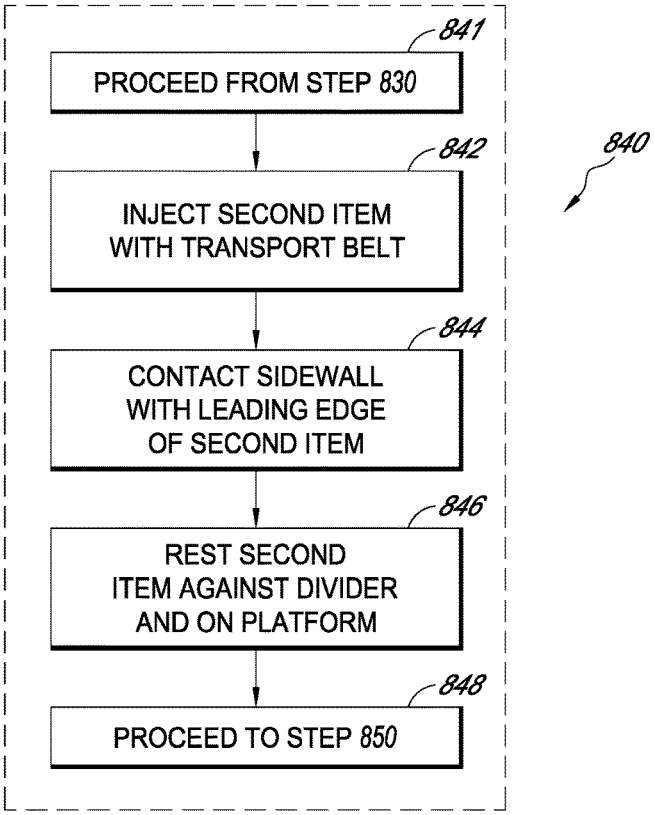
FIG. 7E is a flowchart of an embodiment of a method for moving a second item into a pocket that may be used with the method of FIG. 7A.

FIG. 7E is a flowchart of an embodiment of the step 840. As shown, the step 840 begins with sub-step 841 where it proceeds from the step 830. The step 840 continues with the sub-step 842 wherein the belts 314 and 322 of injector 300 inject the item 10C into the pocket 200. The diverter 318 may also actuate in sub-step 842 to divert the item 10C along the direction 1 for insertion along the direction 3. The step 840 then continues with sub-step 844 wherein a leading edge of the second item contacts a sidewall. For example, in sub-step 844 the first end 12C of the item 10C contacts the rear wall portion 213 in the pocket 200. The step 840 then continues with sub-step 846 wherein the second item rests against the divider and the shelf. For example, the item 10C in sub-step 846 comes to rest on the shelf 201 and against the divider 360. The step 840 then continues to sub-step 848 where the method 840 proceeds to step 850 of FIG. 7A or 7F and performs as described herein.

Figure 7F:
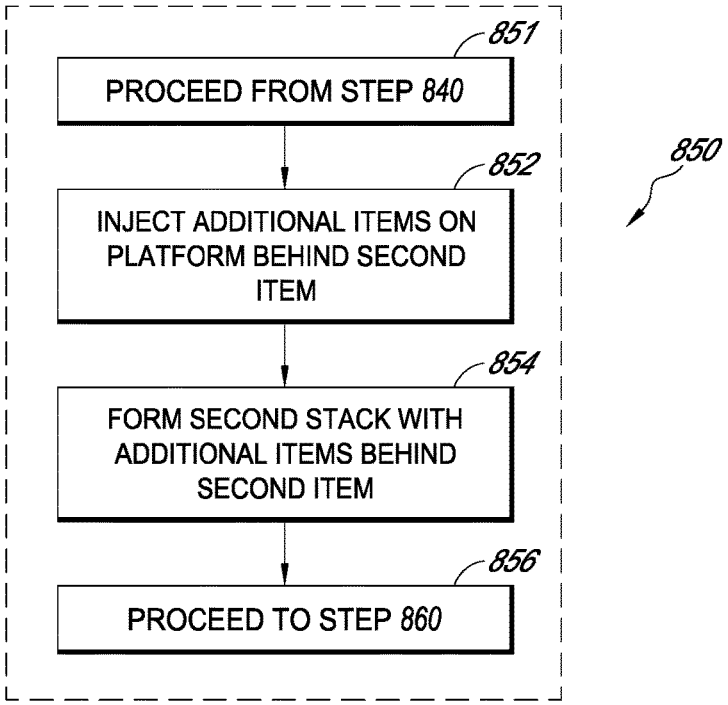
FIG. 7F is a flowchart of an embodiment of a method for forming a second stack that may be used with the method of FIG. 7A.

FIG. 7F is a flowchart of an embodiment of the step 850. As shown, the step 850 begins with sub-step 851 where it proceeds from step 840. The step 850 continues with the sub-step 852 wherein additional items are injected onto the shelf behind the second item. For example, in step 850 one or more of the items 10 are injected by injector 300 onto the shelf 201 behind the item 10C. The step 850 then continues with sub-step 854 wherein a second stack is formed with the additional items behind the second item. For example, in step 850 the rear item 10D is injected by the injector 300 against the additional items 10 to form the second stack 30. The step 850 then continues to sub-step 856 where the method 850 proceeds to step 860 of FIG. 7A and performs as described herein.

Figure 7G:
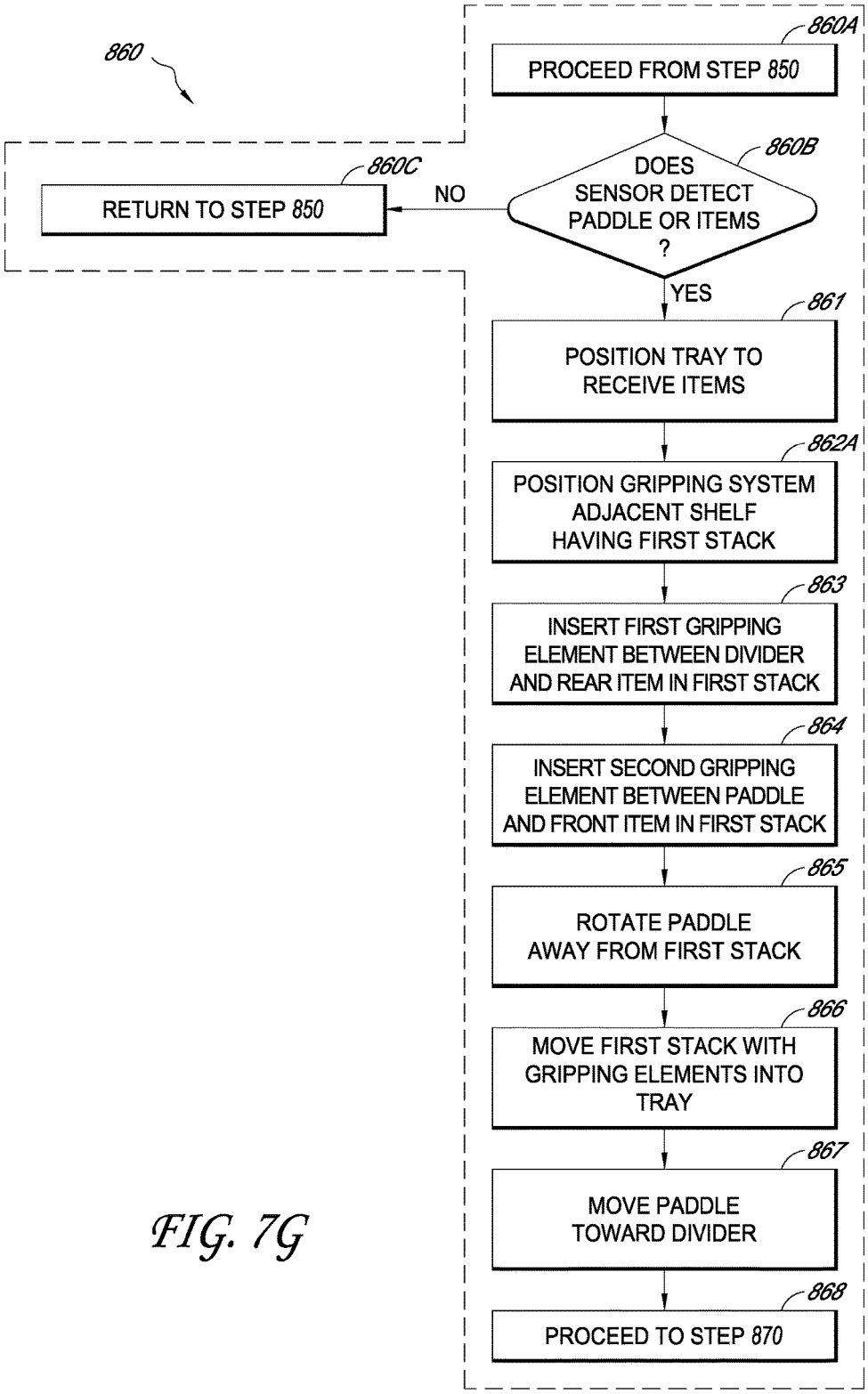
FIG. 7G is a flowchart of an embodiment of a method for removing a first stack that may be used with the method of FIG. 7A.

FIG. 7G is a flowchart of an embodiment of the step 860. As shown, the step 860 begins with sub-step 860A where it proceeds from step 850. The step 860 continues with the decision sub-step 860B where it is determined if the sensor 216A or 216B detects the items 10 or paddle 220 at a particular location of the pocket 200. Decision sub-step 860B may involve the same or similar approaches as decision step 823, as described for example with respect to FIG. 7A. If the sensor detects the paddle or items in decision sub-step 860B, then the method 860 moves to sub-step 861. However, if in decision sub-step 860B the sensor does not detect the item or paddle, the method 860 moves to sub-step 860C where it returns to step 850 to further grow the second stack of items.

If it is determined in decision sub-step 860B that the sensor 216A or 216B detects the items 10 or the paddle 220, the method 860 moves to sub-step 861 wherein a tray is positioned to receive the items. For example, in sub-step 861 the tray 400 is positioned as shown in FIG. 4B adjacent the shelf 201 for receiving the first stack 20 of sorted items 10. The tray 400 may be positioned on the carriage 500 and transported, either manually or automatically, to the corresponding pocket 200 for receipt of the stack 20.

The step 860 continues with sub-step 862A wherein the gripping system 450, such as a robot, is positioned adjacent the pocket 200 of shelf 201 having the first stack 20 of items 10, for instance as shown in FIG. 4C. Other types of gripping systems may be used in sub-step 862A. For example, the gripping system 450 may be built into the shelf 201 and/or pockets 200 such that the gripping system 450 is already in position. In some embodiments, the gripping system 450 slides or otherwise moves along the shelf 201 and/or up and down the rows 142 of shelves 201 to position the gripping system 450 adjacent a particular pocket 200 and/or shelf 201. Thus, by "adjacent," it is meant the gripping system 450 may be in any position near the shelf 201, including but not limited to the sides, top, front or back of the shelf 201, where the gripping system 450 can cause the stack 20 to be removed from the pocket 200.

The step 860 continues with sub-step 863 wherein the gripping element 480 is inserted in between the divider 360 and the rear item 10B, for instance as shown in FIG. 4C. Sub-step 863 may make use of various features of the divider and/or gripping element to facilitate inserting the gripping element between the items 10 in the stack 20 and the divider 360 or the paddle 220. For instance, the divider may have grooves or slots on the surface facing the rear item corresponding to features of the gripping element to allow the gripping element to easily fit in between the rear item and the divider.

The step 860 continues with sub-step 864 wherein the gripping element 470 is inserted in between the paddle 220 and the front item 10A, for instance as shown in FIG. 4C. Sub-step 864 may make use of various features of the paddle and/or gripping element to facilitate insertion. For instance, the paddle may have grooves or slots on the surface facing the front item corresponding to features of the gripping element to allow the gripping element to easily fit in between the front item and the paddle. Sub-step 864 may occur concurrently with sub-step 863, for instance as shown in FIG. 4C. Steps 863 and 864 may also include compression of the first stack with the inserted gripping elements. For example, in steps 863 and 864, the first and second gripping elements 470, 480 may be inserted and then the distance between the two inserted gripping elements 470, 480 may be reduced to maintain contact on both sides of the first stack 20.

The step 860 continues with sub-step 865 wherein the paddle 220 rotates away from the first stack 20, for instance in the direction 11 as shown in FIG. 4C. In sub-step 865, the paddle may rotate away from the first stack and corresponding pocket to allow for easier removal of the first stack from the pocket, for example to allow for sliding of the first stack 20 along the pocket 200 and into the tray 400.

The step 860 continues with sub-step 866 wherein the gripping elements 470, 480 move the first stack 20 into the adjacently positioned tray 400, for instance as shown in FIG. 4D. In sub-step 866, the first stack 20 is slid along the pocket 200 and into the tray 400. In some embodiments, in sub-step 866 the gripping elements 470, 480 may grasp the first stack and rotate or otherwise remove the first stack out of the pocket 200, the gripping system 450 may then move to the tray 400, and then the gripping elements 470, 480 may rotate toward the tray 400 to place the first stack 20 in the tray 400. These are just some examples and other suitable approaches to moving the first stack with the gripping system 450 into a tray may be implemented. In these or other embodiments, sub-step 866 may include the gripping elements 470, 480 decompressing, for example moving farther away from each other, the first stack 20 in the tray 400 and rotating the gripping elements 470, 480 out of the tray 400. Sub-step 866 may also include the gripping system 450 moving to another pocket for removal of another stack of items 10.

The step 860 continues with sub-step 867 wherein the paddle 220 is moved toward the divider 360. For example, in sub-step 867 the paddle 220 moves along the rail 214 of wall 210 toward the divider 360, for instance in the direction 13 as shown in FIG. 4D. Sub-step 867 may also include rotation of the paddle 220 toward the pocket 200, for example rotation in the direction 8 as indicated in FIG. 4D. Sub-step 867 may be performed as soon as the first stack 20 of items 10 is removed from the pocket 200. The method 860 continues to sub-step 868, where the method 860 proceeds to step 870 of FIG. 7A and performs as described above.

The flow chart sequences are illustrative only. A person of skill in the art will understand that the steps, decisions, and processes embodied in the flowcharts described herein may be performed in an order other than that described herein. Thus, the particular flowcharts and descriptions are not intended to limit the associated processes to being performed in the specific order described.

While the above detailed description has shown, described, and pointed out novel features of the invention as applied to various embodiments, it will be understood that various omissions, substitutions, and changes in the form and details of the device or process illustrated may be made by those skilled in the art without departing from the spirit of the invention. As will be recognized, the present invention may be embodied within a form that does not provide all of the features and benefits set forth herein, as some features may be used or practiced separately from others. The scope of the invention is indicated by the appended claims rather than by the foregoing description. All changes which come within the meaning and range of equivalency of the claims are to be embraced within their scope.

The foregoing description details certain embodiments of the systems, devices, and methods disclosed herein. It will be appreciated, however, that no matter how detailed the foregoing appears in text, the systems, devices, and methods may be practiced in many ways. As is also stated above, it should be noted that the use of particular terminology when describing certain features or aspects of the invention should not be taken to imply that the terminology is being redefined herein to be restricted to including any specific characteristics of the features or aspects of the technology with which that terminology is associated.

It will be appreciated by those skilled in the art that various modifications and changes may be made without departing from the scope of the described technology. Such modifications and changes are intended to fall within the scope of the embodiments. It will also be appreciated by those of skill in the art that parts included in one embodiment are interchangeable with other embodiments; one or more parts from a depicted embodiment may be included with other depicted embodiments in any combination. For example, any of the various components described herein and/or depicted in the Figures may be combined, interchanged or excluded from other embodiments.

With respect to the use of substantially any plural and/or singular terms herein, those having skill in the art may translate from the plural to the singular and/or from the singular to the plural as is appropriate to the context and/or application. The various singular/plural permutations may be expressly set forth herein for sake of clarity.

It will be understood by those within the art that, in general, terms used herein are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

All references cited herein are incorporated herein by reference in their entirety. To the extent publications and patents or patent applications incorporated by reference contradict the disclosure contained in the specification, the specification is intended to supersede and/or take precedence over any such contradictory material.

The term "comprising" as used herein is synonymous with "including," "containing," or "characterized by," and is inclusive or open-ended and does not exclude additional, unrecited elements or method steps.

All numbers expressing quantities of ingredients, reaction conditions, and so forth used in the specification and claims are to be understood as being modified in all instances by the term "about." Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should be construed in light of the number of significant digits and ordinary rounding approaches.

The above description discloses several methods and materials of the present invention. This invention is susceptible to modifications in the methods and materials, as well as alterations in the fabrication methods and equipment. Such modifications will become apparent to those skilled in the art from a consideration of this disclosure or practice of the invention disclosed herein. Consequently, it is not intended that this invention be limited to the specific embodiments disclosed herein, but that it cover all modifications and alternatives coming within the true scope and spirit of the invention as embodied in the attached claims.

What is claimed is:

1. A system for sorting items, the system comprising:

a pocket, the pocket comprising a receiving surface, a sidewall located along a first side of the receiving surface, and a paddle moveably coupled with the sidewall;

an injector disposed proximate the pocket, the injector configured to inject a first plurality of items along a path toward the pocket to form a first stack in the pocket; and a progressive displacement system comprising:

a body;

a linear member moveably coupled to the body, the linear member moveable in a first direction and a second direction;

a gear system rotatably coupled with the body and in mechanical communication with the linear member, wherein movement of the linear member is translated to rotational movement of the gear system; and a divider in mechanical communication with the gear system, the divider having a first side and a second side opposite the first side, wherein the rotational movement of the gear system due to movement of the linear member moves the divider between a retracted position and an extended position, wherein a corresponding output movement distance of the divider is greater than an input movement distance by the linear member.

2. The system of claim 1, further comprising a controller in communicating connection with the progressive displacement system, the controller configured to receive first information related to the first plurality of items and to move the divider between the retracted position and the extended position based on the first information.

3. The system of claim 2, the progressive displacement system further comprising an actuator coupled with and configured to move the linear member in the first and second direction.

4. The system of claim 3, wherein in the extended position the divider is located on the path between an outlet of the injector and an inlet of the pocket such that an item injected from the injector will contact the divider, wherein the injector is further configured to inject a second plurality of items in the first direction toward the pocket to form a second stack in the pocket, wherein the second stack is located adjacent to the divider in the extended position with the second side of the divider facing generally toward the second stack, such that the divider at least partially divides the first stack from the second stack to allow removal of the first stack from the pocket while the injector injects the second plurality of items, and wherein in the retracted position the divider is not located on the path between the outlet of the injector and the inlet of the pocket.

5. The system of claim 4, wherein the controller is configured to receive second information related to the second plurality of items and to move the divider between the retracted position and the extended position based on the second information.

6. The system of claim 5, further comprising a sensor in communicating connection with the controller, the sensor configured to detect a characteristic of the first or second plurality of items, wherein the first or second information related to the first or second plurality of items is based on the detected characteristic.

7. The system of claim 6, wherein the characteristic comprises a size of the first stack.

8. The system of claim 6, wherein the characteristic comprises a destination for an item.

9. The system of claim 6, further comprising a paddle coupled with the pocket, wherein the first stack forms against the paddle, the paddle configured to move in response to the first stack forming against the paddle.

10. The system of claim 9, wherein the sensor is a switch configured to be switched by the paddle as the paddle moves over the switch.

11. The system of claim 5, further comprising a gripping system configured to remove the first stack of items from the pocket.

12. The system of claim 5, wherein the pocket further comprises:

a receiving surface;

a sidewall located along a first side of the receiving surface; and a paddle moveably coupled with the sidewall;

wherein the receiving surface is configured to receive the first and second plurality of items to form the first and second stacks thereon, wherein the sidewall and paddle are configured to position the injected first and second plurality of items on the receiving surface and at least partially against the sidewall and paddle, and wherein the paddle is configured to move in response to the first stack forming against the paddle.

13. The system of claim 5, further comprising:

a plurality of the pockets disposed proximate to each other;

a plurality of the injectors, each injector disposed proximate to a corresponding pocket of the plurality of pockets; and a plurality of the dividers, each divider disposed proximate to a corresponding injector of the plurality of injectors, wherein the system is configured to sort and inject the first and second pluralities of items into at least one of the plurality of pockets.

14. A method of sorting items, the method comprising:

injecting a first plurality of items toward a pocket, the pocket comprising a sidewall and a paddle;

forming a first stack in the pocket with the first plurality of injected items, wherein the first item in the first plurality of items contacts the paddle;

moving a linear member in a first direction, wherein the linear member is in mechanical communication with a gear system that is in mechanical communication with a divider;

causing the divider to move based on movement of the linear member in the first direction and mechanical communication to the divider via the gear system;

moving the divider to an extended position that is adjacent to the first stack in response to the movement of the linear member in the first direction; and injecting a second plurality of items to form a second stack in the pocket, wherein the divider in the extended position at least partially divides the first stack from the second stack.

15. The method of claim 14, wherein moving the linear member the first distance comprises moving the linear member the first distance based on information related to the first or second plurality of items.

16. The method of claim 15, further comprising detecting a characteristic of the first or second plurality of items, wherein the information related to the first or second plurality of injected items is based on the detected characteristic.

17. The method of claim 16, wherein the characteristic comprises a size of the first stack.

18. The method of claim 15, further comprising removing the first stack of items from the pocket.

19. The method of claim 15, further comprising receiving a third plurality of items comprising at least the first and second pluralities of items and sorting the third plurality of items into at least the first and second pluralities of items.

20. A system for sorting items, the system comprising:

means for injecting a first and second plurality of items toward a pocket;

means for forming a first stack in the pocket with the first plurality of injected items;

means for moving a linear member a first distance, wherein the linear member is in mechanical communication with a gear system that is in mechanical communication with a divider;

means for causing the divider to move based on movement of the linear member in the first direction and mechanical communication to the divider via the gear system to move;

the divider a second distance to an extended position that is adjacent to the first stack, wherein the second distance is greater than the first distance, and wherein the divider in the extended position at least partially divides the first stack from the second stack.

* * * * *